US007802861B2

(12) United States Patent
Wanibe

(10) Patent No.: US 7,802,861 B2
(45) Date of Patent: Sep. 28, 2010

(54) LIQUID DETECTOR AND LIQUID CONTAINER HAVING THE SAME

(75) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

(21) Appl. No.: 12/325,796

(22) Filed: Dec. 1, 2008

(65) Prior Publication Data

US 2009/0174734 A1 Jul. 9, 2009

(30) Foreign Application Priority Data

Nov. 30, 2007 (JP) ..... 2007-311195

(51) Int. Cl.
*B41J 2/195* (2006.01)

(52) U.S. Cl. ..... 347/7; 347/19; 347/84; 347/86

(58) Field of Classification Search ..... 347/7
See application file for complete search history.

(56) References Cited

U.S. PATENT DOCUMENTS 6,536,861 B1 * 3/2003 Usui et al. ..... 347/7
7,448,717 B2 * 11/2008 Wanibe et al. ..... 347/19
7,562,952 B2 * 7/2009 Yamamoto ..... 347/7

FOREIGN PATENT DOCUMENTS

| | | | |
|---|---|---|---|
| JP | 2001-146030 | A | 5/2001 |
| JP | 2006-281550 | A | 10/2006 |
| JP | 2006-341599 | A | 12/2006 |
| JP | 2007-15408 | A | 1/2007 |

* cited by examiner

*Primary Examiner*—Matthew Luu
*Assistant Examiner*—Brian J Goldberg
(74) *Attorney, Agent, or Firm*—Sughrue Mion, PLLC

(57) ABSTRACT

A liquid detector includes: a case; a sensor base; a sensor chip; and a partition wall, dividing a part of a flow channel in the case into an upstream and downstream buffer chambers. The sensor chip includes a sensor cavity adapted to receive a liquid to be detected. The sensor base has: a first hole through which the liquid is introduced from the upstream buffer chamber to the sensor cavity; and a second hole through which the liquid is introduced from the sensor cavity to the downstream buffer chamber. The first and second holes are arranged in parallel at the same height, the partition wall is arranged between the first and second holes so as to extend along the sensor base, and a bottom bypass is formed at a lowermost position of the upstream and downstream buffer chambers to communicate the upstream and downstream buffer chambers with each other.

20 Claims, 16 Drawing Sheets

LIQUID DETECTOR AND LIQUID CONTAINER HAVING THE SAME

BACKGROUND

1. Technical Field

The present invention relates to a liquid detector that is adapted to detect the residual quantity of a liquid (ink) in a liquid consuming apparatus, such as an ink jet recording apparatus, and a liquid container having the liquid detector.

2. Related Art

As a representative one of known liquid consuming apparatuses, an ink jet recording apparatus is known that has an ink jet recording head for image recording. Other liquid ejecting apparatus include, for example, an apparatus that has a color material ejecting head, which is used in manufacturing color filters of a liquid crystal display or the like, an apparatus that has an electrode material (conductive paste) ejecting head, which is used in forming electrodes of an organic EL display or a field emission display (FED), an apparatus that has a bioorganic material ejecting head, which is used in manufacturing a bio chip, and an apparatus that has a sample ejecting head for ejecting a sample as a precision pipette.

In the ink jet recording apparatus, which is the representative liquid consuming apparatus, an ink jet recording head has a pressure generation unit for pressurizing a pressure generation chamber and nozzle openings for ejecting pressurized ink as ink droplets. The ink jet recording head is mounted on a carriage. Ink in an ink container is supplied to the recording head through a flow channel in succession, such that printing is continuously performed. The ink container is formed of a detachable cartridge that can be simply replaced with new one by a user when ink is consumed.

As a method of managing ink consumption of the ink cartridge, there is a method that manages ink consumption by totalizing the number of droplets ejected from the recording head or the amount of ink absorbed through maintenance using software, or a method that manages a time, at which ink of a predetermined amount is actually consumed, by attaching liquid level detection electrodes to the ink cartridge.

However, the method of managing ink consumption by totalizing the number of droplets to be ejected or the amount of ink using software has the following problems. Of the heads, there are those that eject ink droplets with a variation in weight. The variation in weight between the ink droplets does not have an effect on image quality, but the ink cartridge needs to be filled with ink in an amount with a margin, taking into consideration of a cumulative error of ink consumption due to the variation. For this reason, in some cases, ink may remain by the amount corresponding to the margin.

Meanwhile, according to method of managing the time, at which ink is consumed, by electrodes, an actual amount of ink can be detected, and thus the residual quantity of ink can be managed with high reliability. However, since this method relies upon conductivity of ink in detecting the liquid level of ink, kinds of detectable ink are limited, and the seal structure of the electrodes becomes complicated. Further, the electrodes are usually made of a noble metal having good conductivity and high corrosion resistance, and accordingly manufacturing costs of the ink cartridge may be increases. Since two electrodes need to be attached, the number of manufacturing steps may be increased, and as a result, manufacturing costs may be increased.

As one of the devices that have been developed in order to solve the above-described problems, a piezoelectric device (herein, referred to as a sensor unit) is disclosed in JP-A-2001-146030. This sensor unit monitors the residual quantity of ink in the ink cartridge using the fact that a resonant frequency of a residual vibration signal changes due to residual vibration (free vibration) of a vibrating plate after compulsory vibration between the cases of presence of ink in a sensor cavity opposite to the vibrating plate having laminated thereon a piezoelectric element and of absence of ink in the sensor cavity.

JP-A-2006-281550 discloses a technology that seals a metal sensor base with a film with a sensor chip including a piezoelectric element mounted in a concave place of a unit base, thereby forming an assembly. The sensor base of the unit base is arranged to face an ink delivery channel of the ink container.

According to the liquid detection device described in JP-A-2006-281550, a sensor cavity is provided in an ink flow channel, and ink flowing in the sensor cavity has large flow channel resistance. To solve this problem, JP-A-2006-341599 discloses a technology that provides a bypass passage communicating an upstream buffer chamber and a downstream butter chamber, which are divided by a partition wall, in addition to the flow channel of the sensor cavity.

JP-A-2006-341599 describes an example where a sensor base having a hole on each of the left and right sides is arranged in a horizontal direction, and the sensor cavity turns downward at the upper parts of both the buffer chambers. The upstream buffer chamber and the downstream buffer chamber are divided by the partition wall and arranged in parallel in a horizontal direction.

The bypass passage is provided at the lower parts of the upstream buffer chamber and the downstream buffer chamber (in JP-A-2006-341599, see claim 2 and FIG. 6).

Therefore, ink remaining in the upstream buffer chamber can be discharged to the downstream buffer chamber by the bypass passage.

According to the structures in JP-A-2006-281550 and JP-A-2006-341599, ink in the upstream buffer chamber goes toward the sensor cavity above the sensor base through a hole of the sensor base, which is formed at the upper part of the upstream buffer chamber. Accordingly, it air bubbles enter the upstream buffer chamber, the air bubbles having low specific gravity go upward in a vertical direction. For this reason, in the structures of JP-A-2006-281550 and JP-A-2006-341599, even though the upstream buffer chamber is filled with ink, that is, "ink present", it air bubbles are mixed in ink, the air bubbles are moved to the sensor cavity, "ink absent" may be erroneously detected, To solve this problem, the inventors have examined the sensor base which is arranged vertically or obliquely, unlike the structures described in JP-A-2006-281550 and JP-A-2006-341599. If the ink detection structure described in JP-A-2006-281550 or JP-A-2006-341599 is arranged vertically as it is, the upstream buffer chamber above the partition wall is connected to the downstream buffer chamber below the partition wall by the vertical bypass passage.

Accordingly, it is difficult to make the flow of ink toward the sensor cavity forming a part of a U-shaped flow channel independent.

According to the structures described in JP-A-2006-281550 and JP-A-2006-341599, the sensor base is also supported by the partition wall or a peripheral wall. For this reason, in a region where a slight gap is formed with respect to the sensor base, ink remains due to a capillary phenomenon. Accordingly, when the "ink absent" state is detected (air enters the cavity) white the recording head is moved and printing is performed, and the recording head returns to a home position, ink from the gap may flow into the sensor cavity and the "ink present" state may be erroneously detected. In this case, idle printing may be performed, and the lifespan of the recording head may be shortened.

SUMMARY

An advantage of some aspects of the invention is that it provides a liquid detector having a structure, which is resistant to erroneous detection, and a liquid container having the liquid detector. Another advantage of some aspects of the invention is that it provides a liquid detector having a structure, which is resistant to erroneous detection and easily discharges a liquid remaining in an upstream buffer chamber to a downstream side, and a liquid container having the liquid detector.

According to an aspect of the invention, there is provided a liquid detector includes: a case, having an opening through which a flow channel is exposed; a sensor base, having a first surface facing the flow channel through the opening, and having a second surface opposite to the first surface; a sensor chip, mounted on the second surface of the sensor base; a film, adapted to hold the sensor base in the opening, and adapted to seal the opening; and a partition wall, dividing a part of the flow channel in the case into an upstream buffer chamber and a downstream buffer chamber. The sensor chip includes a sensor cavity adapted to receive a liquid to be detected. The sensor base has: a first hole through which the liquid is introduced from the upstream buffer chamber to the sensor cavity; and a second hole through which the liquid is introduced from the sensor cavity to the downstream buffer chamber. During liquid detection, the first and second holes are arranged in parallel at the same height in a vertical direction, the partition wall is arranged between the first and second holes so as to extend along the sensor base in the vertical direction, and a bottom bypass is formed at a lowermost position in the vertical direction of each of the upstream and downstream buffer chambers to communicate the upstream and downstream buffer chambers with each other.

The invention contains subject matter related to Japanese Patent Application No 2007-311195 filed in the Japanese Patent Office on Nov. 30, 2007, the entire contents of which are incorporated herein by reference.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail. Note that the embodiment described below is not intended to limit the scope of the invention, and all the components described in the embodiment are not always necessary as a solution of the invention.

(Overview of Ink Cartridge)

An ink cartridge (liquid container) equipped with a liquid detector according to an embodiment of the invention will be described with reference to the drawings.

Figure 1:
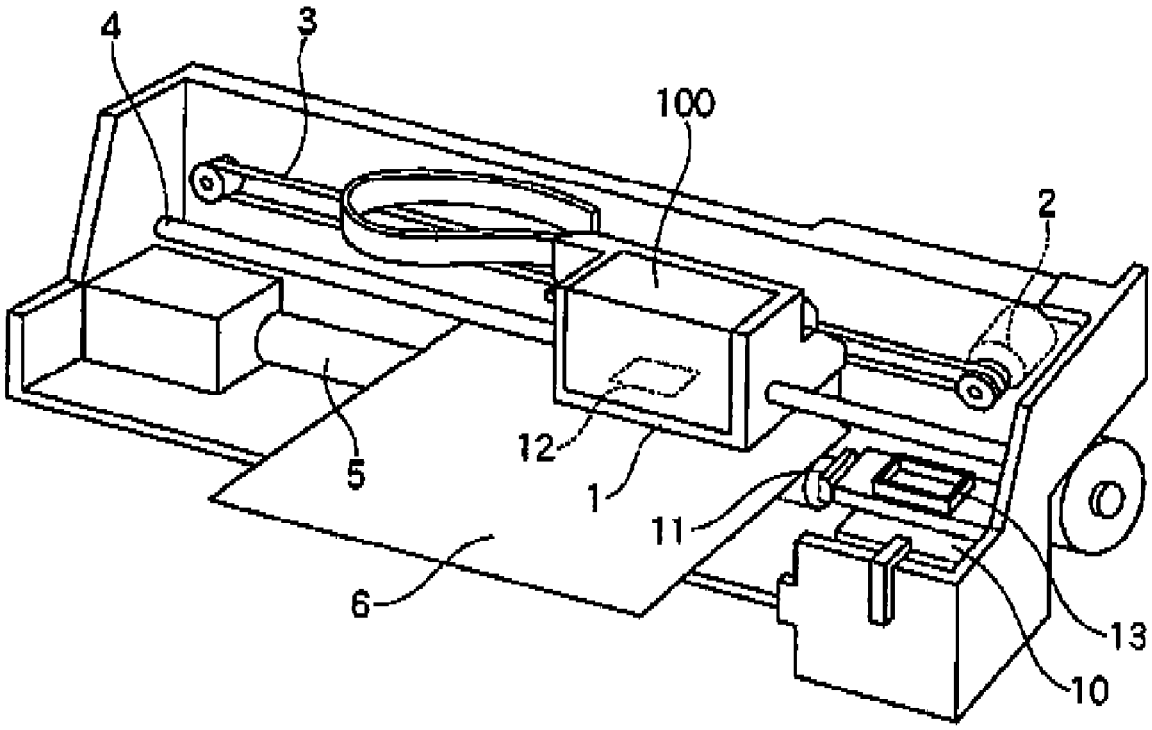
FIG. 1 is a schematic perspective view of an ink jet printer, which is a liquid consuming apparatus.

FIG. 1 shows the schematic configuration of an ink jet recording apparatus (liquid consuming apparatus) that uses the ink cartridge of this embodiment. A carriage 1 is guided by a guide member 4 and reciprocates in an axial direction of a platen 5 through a timing belt 3, which is driven by a carriage motor 2.

An ink jet recording head 12 is mounted on a side of the carriage 1 facing a recording sheet 6. An ink cartridge 100 that supplies ink to the recording head 12 is detachably mounted in a holder (not shown) provided at an upper part of the carriage 1.

A cap member 13 is disposed at a home position (a right side in FIG. 1), which is a non-printing region of the recording apparatus. When the recording head 12 mounted on the carriage 1 is moved to the home position, the cap member 13 is pressed into contact with a nozzle forming surface of the recording head 12 and forms a closed space with the nozzle forming surface. A pump unit 10 is disposed below the cap member 13 to apply a negative pressure to the closed space formed by the cap member 13 and to perform cleaning or the like.

In the vicinity of the cap member 13 near a printing region, a wiping unit 11 having an elastic plate, such as rubber, is disposed so as to advance and retreat, for example, in a horizontal direction with respect to the movement trace of the recording head 12. If necessary, when the carriage 1 reciprocates toward the cap member 13, the wiping unit 11 wipes the nozzle forming surface of the recording head 12.

Figure 2:
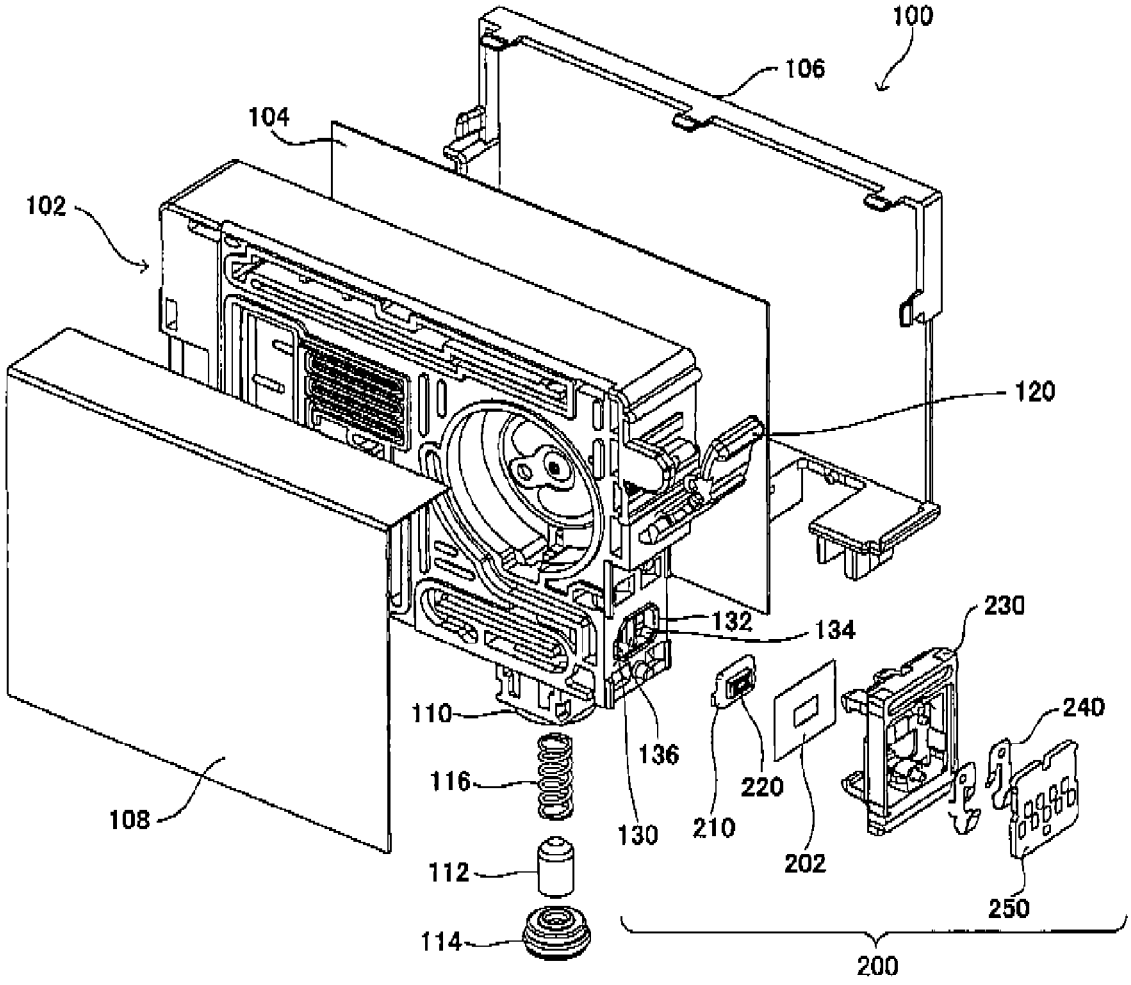
FIG. 2 is an exploded perspective view of an ink cartridge that is detachably mounted on a carriage of a printer.

FIG. 2 is an exploded perspective view showing the schematic configuration of the ink cartridge 100. FIG. 1 shows the ink cartridge 100 that is arranged to be aligned with an up-down direction when being mounted on the carriage 1. In the following description, therefore, the terms "up/down" means the up-down direction in a state where the ink cartridge 100 is mounted on the carriage 1.

The ink cartridge 100 has a body case 102, a film 104 that covers a rear surface of the body case 102, a cover 106 that covers the film 104 and a bottom surface of the body case 102, and a film 108 that covers a front surface and a top surface of the body case 102.

The body case 102 is divided complex by ribs or walls. The body case 102 is provided with an ink flow channel having an ink containing region and an ink delivery channel, an ink side passage that communicates the ink containing region with the atmosphere, and an atmosphere communicating portion having an atmosphere valve accommodating chamber and an atmosphere side passage, but detailed descriptions of them will be omitted (for example, see JP-A-2007-15406).

The ink delivery channel of the ink flow channel finally communicates with an ink supply portion 110. Ink in the ink cartridge 100 is sucked and supplied from the ink supply portion 110 by the negative pressure.

An ink supply needle (not shown) of the holder provided in the carriage 1 is fitted into the ink supply portion 110. The ink supply portion 110 has a supply valve 112 that is pressed by the ink supply needle to. 6 slide and be opened, a seal member 114 that is made of an elastic material, such as elastomer, to be fitted around the ink supply needle, and an urging member 116 that is formed of a coil spring to urge the supply valve 112 toward the seal member 114. These are assembled by loading the urging member 116, fitting the seal member 114 to the ink supply portion 110, and finally compressing the supply valve 112.

A lever 120 is provided on one side surface of the body case 102. The lever 120 is engaged with the holder provided in the carriage 1. On the one side surface of the body case 102, an opening 130, to which an end of the ink delivery channel is connected, is formed on an upstream side of the ink supply portion 110, for example, below the lever 120. A welding rib 132 is formed at the edge of the opening 130. A partition wall rib 136 is formed to divide an ink delivery channel 134 facing the opening 130 into an upstream buffer chamber 134*a* and a downstream buffer chamber 134*b* (reference numerals are omitted in FIG. 2) (see FIGS. 3, 6, and 7 described below).

(Ink Detection Device)

Figure 3:
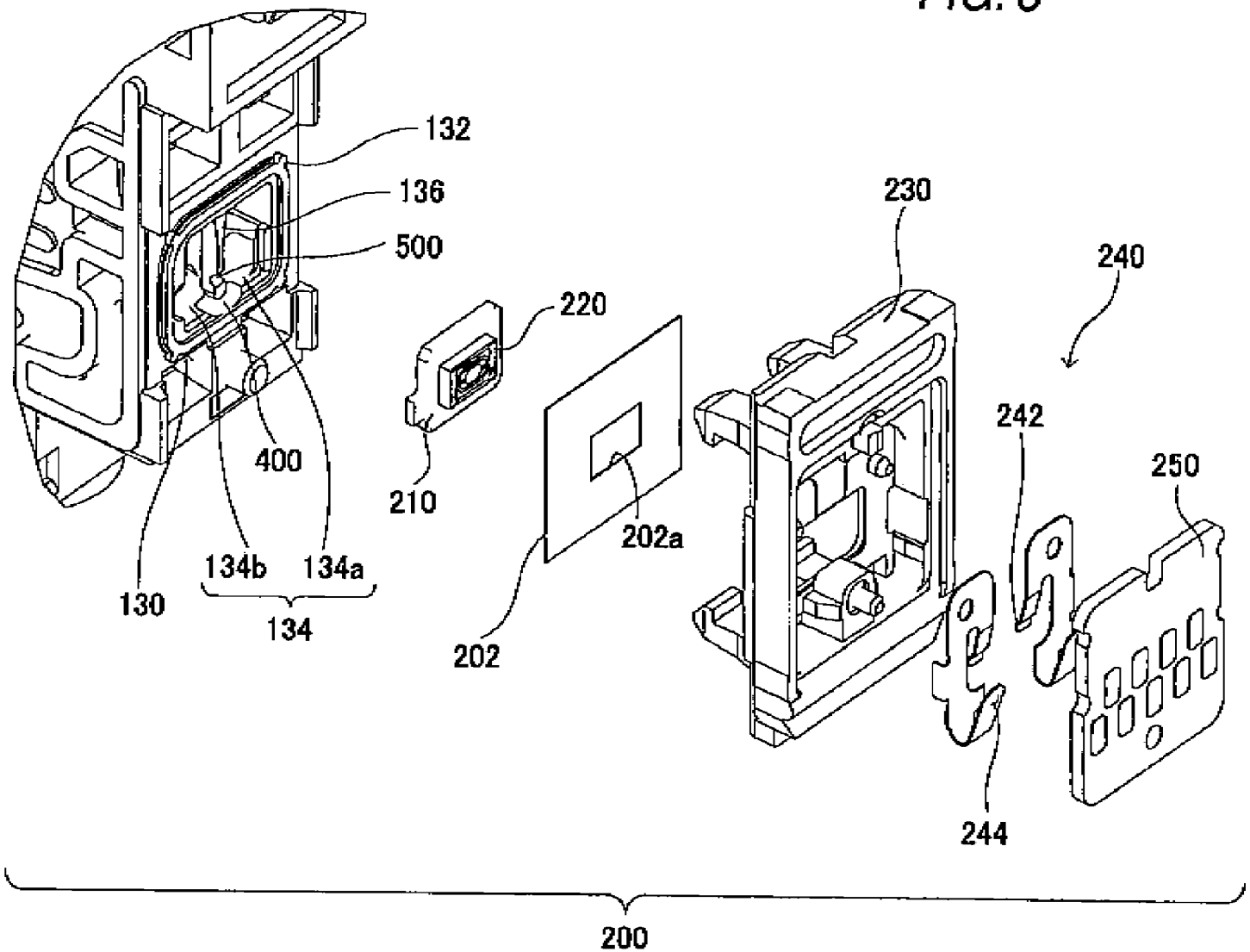
FIG. 3 is an exploded perspective view of an ink detection device and shows a part of FIG. 2 on magnified scale.

Next, an overview of an ink detection device 200 as a liquid detector according to the invention, which has the body case 102, the ink delivery channel 134, and the partition wall rib 136, will be described with reference to FIGS. 2 and 3. FIG. 3 shows the ink detection device 200 in the ink cartridge 100 of FIG. 2 on magnified scale.

In FIGS. 2 and 3, the ink detection device 200 includes a body case 102, made of resin, in which the ink delivery channel 134 is formed, a sensor base 210, made of a metal, which is disposed to face the ink delivery channel 134 from the opening 130 of the body case 102, a sensor chip 220 that is mounted on a surface of the sensor base 210, which is opposite to a surface facing the ink delivery channel 134, a film 202 that holds the sensor base 210 in the opening 130 and seals the opening 130, and a partition wall 136 that divides the ink delivery channel 134 in the body case 102 into the upstream buffer chamber 134*a* and the downstream buffer chamber 134*b*. The film 202 is adhered to a top surface of the sensor base 210 and welded to the welding rib 132 around the opening 130.

A bottom bypass 400 and an intermediate bypass 500 are not shown in FIG. 3, and the details thereof will be described below.

In FIGS. 2 and 3, the ink detection device 200 may further include a pressing cover 230 that is disposed above the sensor base 210, the sensor chip 220, and the film 202, a relay terminal 240 that is accommodated in the pressing cover 230, and has a terminal 242, which is electrically connected to the sensor chip 220 through a hole 202*a* formed in the film 202, and a circuit board 250 that is accommodated in the pressing cover 230, and is electrically connected to a terminal 244 of the relay terminal 240. In the ink detection device 200 according to the invention, the pressing cover 230, the relay terminal 240, and the circuit board 250 are not essential components.

Figure 4:
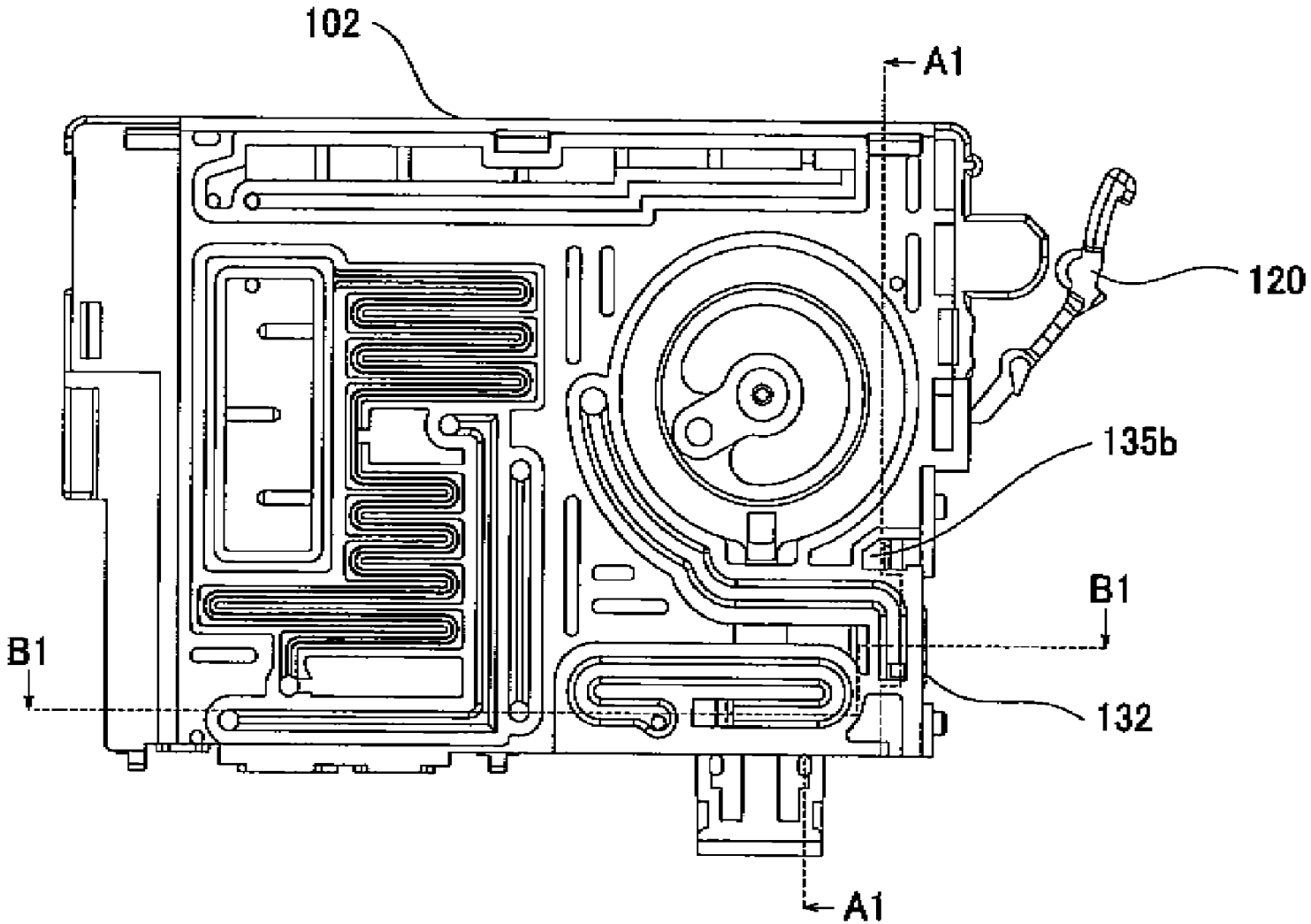
FIG. 4 is a front view of an ink cartridge.
Figure 5:
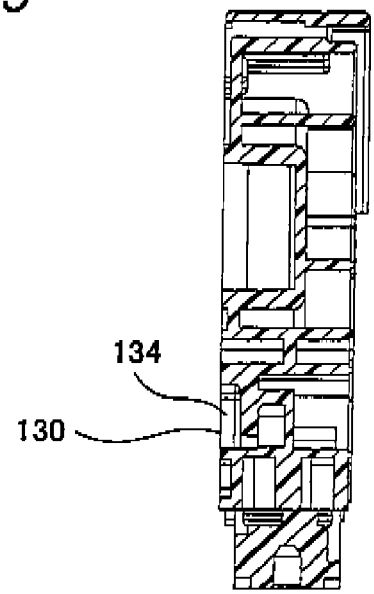
FIG. 5 is a sectional view taken along the line A1-A1 of FIG. 4.

The details of the ink detection device 200 will be described with reference to FIGS. 4 to 17. FIG. 4 is a front view of the body case 102. As shown in FIG. 5, which is a sectional view taken along the line A1-A1 of FIG. 4, the ink delivery channel 134 is exposed through the opening 130 at its end before the ink supply portion 110 shown in FIG. 1.

Figure 6:
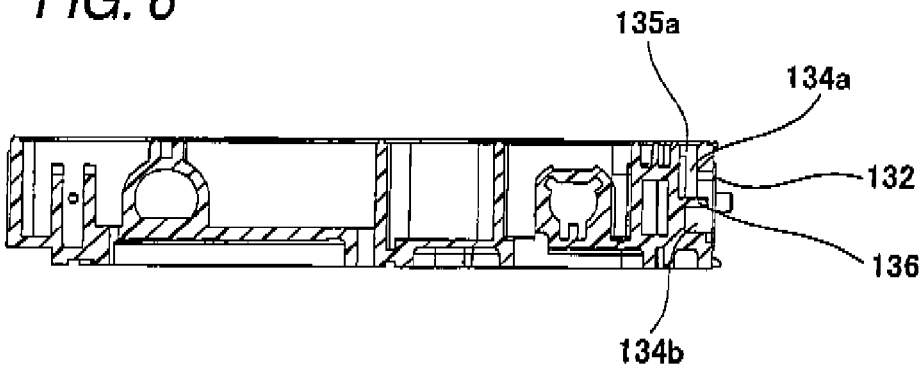
FIG. 6 is a sectional view taken along the line B1-B1 of FIG. 4.
Figure 7:
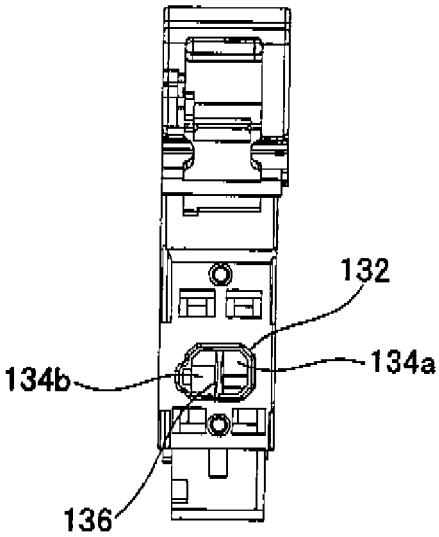
FIG. 7 is a right side view of an ink cartridge.

As shown in FIG. 6, which is a sectional view taken along the line B1-B1 of FIG. 4, and FIG. 7, which is a right side view of the ink cartridge 100, the ink delivery channel 134, which is exposed through the opening 130, is divided into the upstream buffer chamber 134*a* and the downstream buffer chamber 134*b* by the partition wall 136. As shown in FIG. 6, a supply port 135*a* is disposed to face the upstream buffer chamber 134*a*, and as shown in FIG. 4, a discharge port 135*b* is disposed to face the downstream buffer chamber 134*b*.

Figure 8:
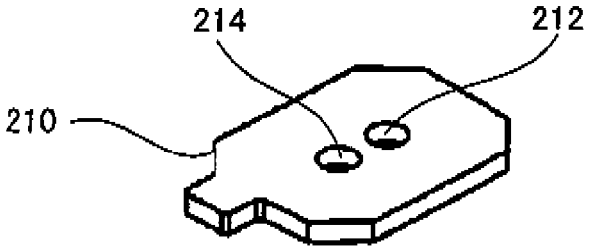
FIG. 8 is a perspective view of a sensor base as viewed from the rear side.
Figure 9:
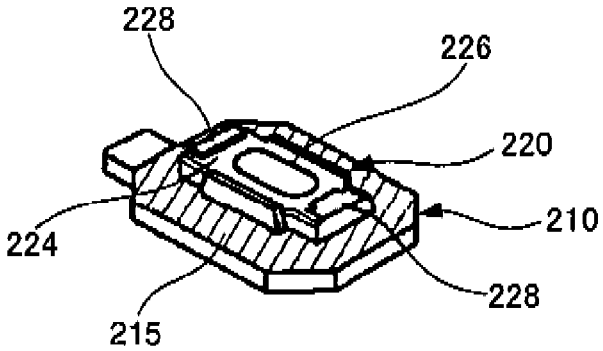
FIG. 9 is a perspective view of a sensor base having mounted thereon a sensor chip as viewed from the front side.

FIG. 8 is a perspective view of the sensor base 210 as viewed from the below. As shown in FIG. 9, the sensor base 210 is provided with a first hole (supply path) 212 and a second hole (discharge path) 214, which pass through the sensor base 210 in its thickness direction.

Figure 10:
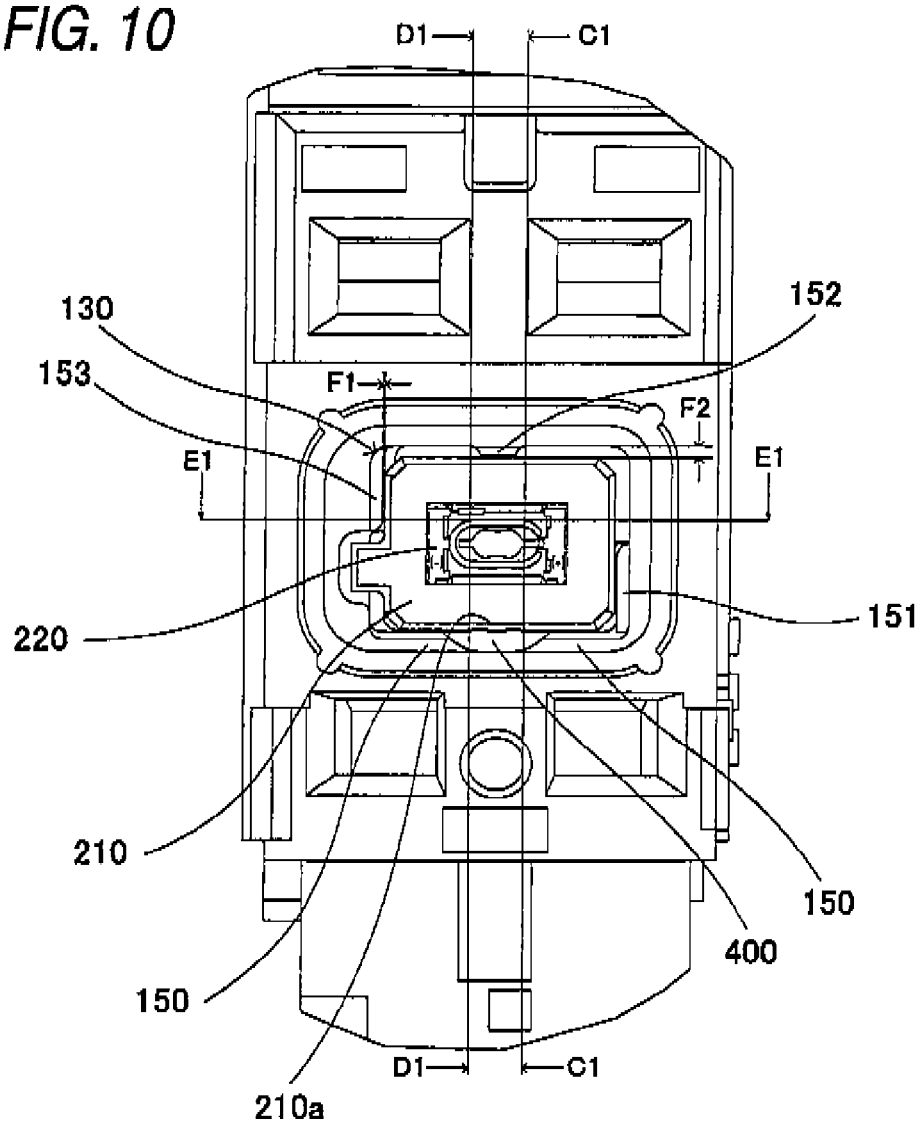
FIG. 10 is a plan view schematically showing a state where a sensor base and a sensor chip of an ink detection device are arranged in an opening and assembled.
Figure 11:
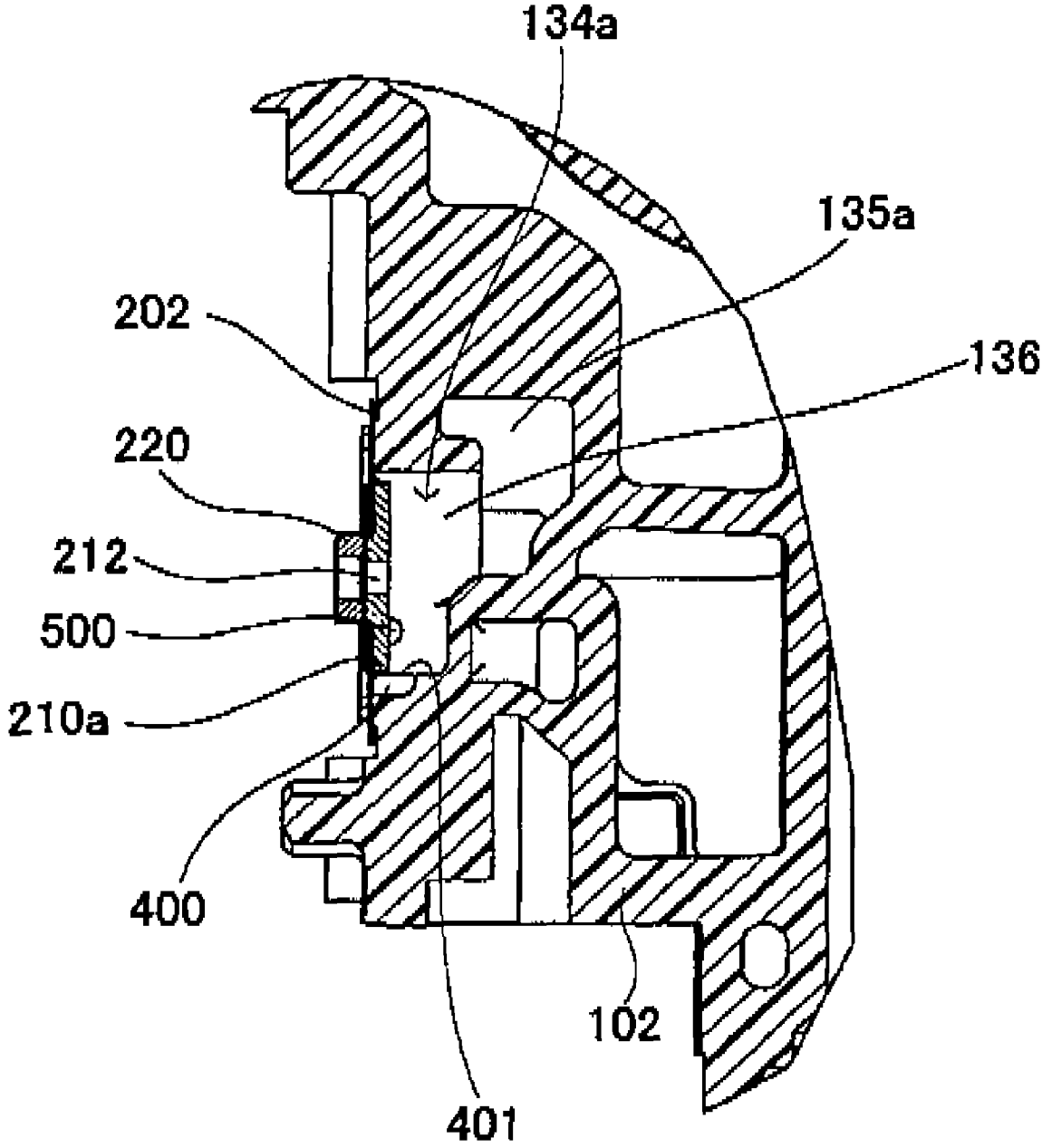
FIG. 11 is a sectional view taken along the line C1-C1 of FIG. 10.
Figure 12:
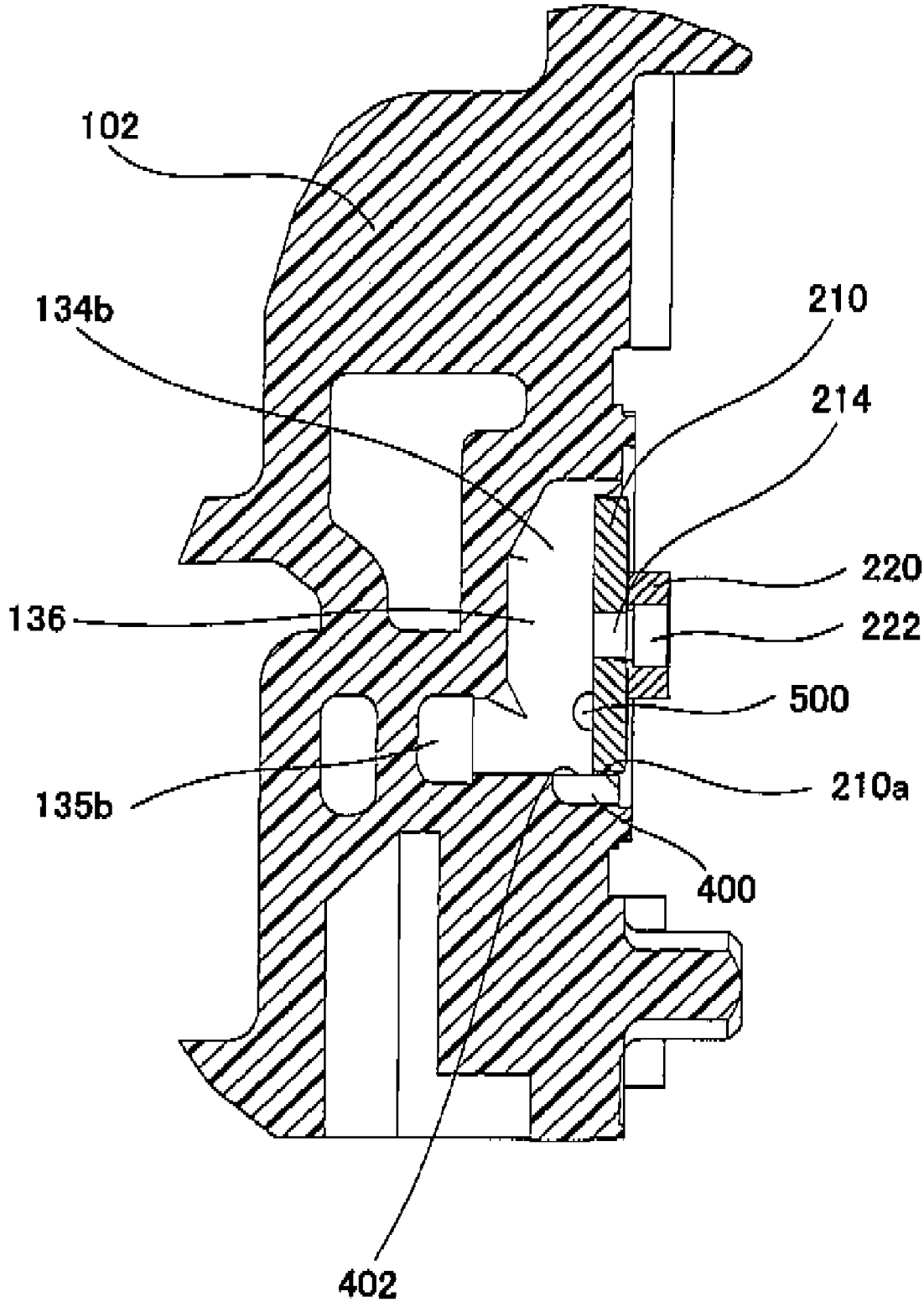
FIG. 12 is a sectional view taken along the line D1-D1 of FIG. 10.
Figure 13:
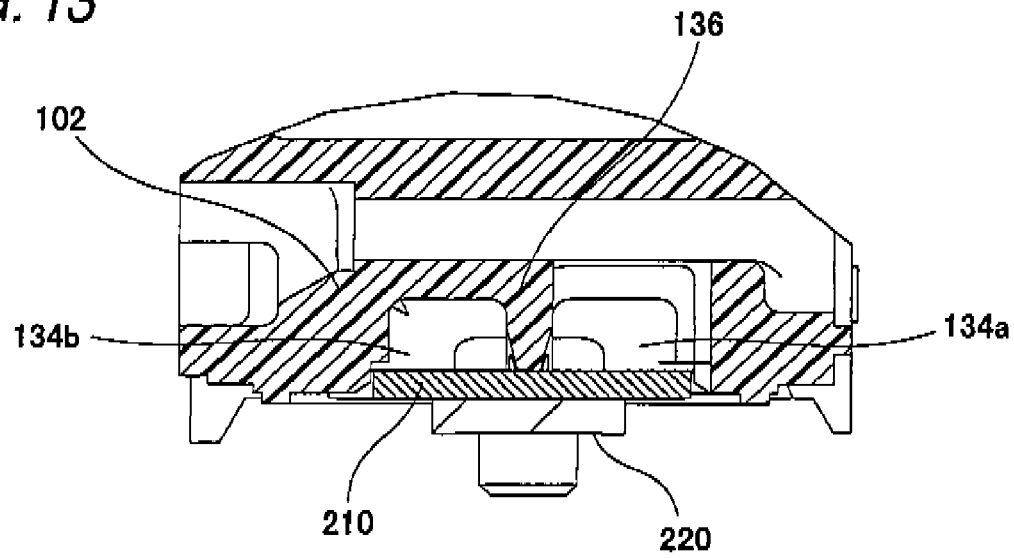
FIG. 13 is a sectional view taken along the line E1-E1 of FIG. 10.
Figure 14:
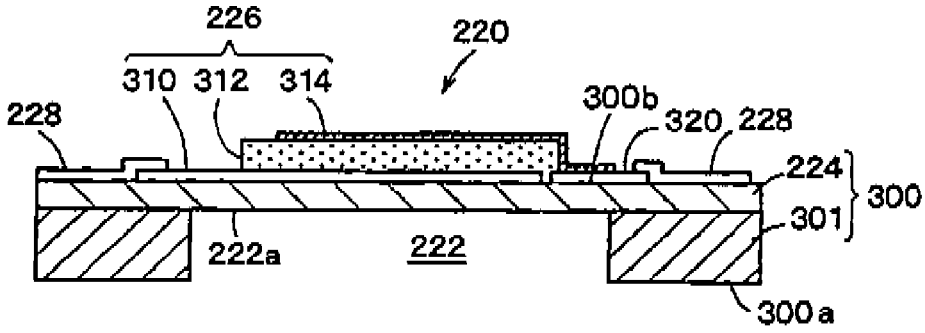
FIG. 14 is a sectional view of a sensor chip.

FIG. 9 is a perspective view of the sensor base 210 having mounted thereon the sensor chip 220 as viewed from the above. FIG. 10 is a plan view schematically showing a state where the sensor base 210 and the sensor chip 220 of the ink detection device 200 shown in FIGS. 2 and 3 are arranged in the opening. FIG. 11 is a sectional view taken along the line C1-C1 of FIG. 10. FIG. 12 is a sectional view taken along the line D1-D1 of FIG. 10. FIG. 13 is a sectional view taken along the line E1-E1 of FIG. 10. FIG. 14 is a sectional view of the sensor chip.

In FIGS. 11, 12, and 14, the sensor chip 220 has a sensor cavity 222 that receives ink (liquid) to be detected. A rear surface of the sensor cavity 222 is opened so as to receive ink. A front surface of the sensor cavity 222 is covered with a vibrating plate 224, as shown in FIGS. 9 and 14. A piezoelectric element 226 is disposed on a surface of the vibrating plate 224.

Specifically, as shown in FIG. 14, the sensor chip 220 has a vibration cavity forming base 300 that is formed by stacking the vibrating plate 224 on a cavity plate 301, and has a first surface 300*a* and a second surface 300*b* opposite to the first surface 300*a*. The sensor chip 220 further has the piezoelectric element 226 that is stacked on the second surface 300*b* of the vibration cavity forming base 300.

The cavity 222 that has a cylindrical spatial shape and receives a medium (ink) to be detected is formed in the vibration cavity forming base 300 so as to be opened on the first surface 300*a*. A bottom portion 222*a* of the cavity 222 can vibrate due to the vibrating plate 224. In other words, a portion of the vibrating plate 224, which actually vibrates, is specified by the cavity 222. Electrode terminals 228 and 228 are formed at both ends on the second surface 300*b* of the vibration cavity forming base 300.

A lower electrode 310 is formed on the second surface 300*b* of the vibration cavity forming base 300. The lower electrode 310 is connected to one of the electrode terminals 228.

A piezoelectric layer 312 is stacked on the lower electrode 310, and an upper electrode 314 is stacked on the piezoelectric layer 312. The upper electrode 314 is connected to an auxiliary electrode 320, which is insulated from the lower electrode 310. The other electrode terminal 228 is connected to the auxiliary electrode 320.

The piezoelectric element 226 functions to determine an ink end on the basis of a difference in electric characteristic (for example, frequency) due to presence and absence of ink in the sensor cavity 222. As the material for the piezoelectric layer, lead zirconate titanate (PZT), lead lanthanum zirconate titanate (PLZT), a leadless piezoelectric film, or the like may be used.

The sensor chip 220 is fixed to the sensor base 210 by an adhesive layer 215 as a single body by placing a bottom surface of a chip main body at the center of the top surface of the sensor base 210. A space between the sensor base 210 and the sensor chip 220 is sealed by with the adhesive layer 215.

(Detection of Ink Residual Quantity)

As shown in FIG. 11, ink introduced from the ink delivery channel 134 through the supply port 135*a* remains in the upstream buffer chamber 134*a*, which is one of the chambers divided by the partition wall 136.

The upstream buffer chamber 134*a* communicates with the sensor cavity 222 of the sensor chip 220 through the first hole 212 of the sensor base 210. For this reason, ink in the upstream buffer chamber 134*a* is introduced into the sensor cavity 222 through the first hole 212 when ink is supplied. A vibration from the vibrating plate 224 that vibrates due to the piezoelectric element 226 is transmitted to ink, and presence or absence of ink is detected depending on the frequency of the residual vibration waveform. At an end point at which air is mixed into the sensor cavity 222 in addition to ink, the residual vibration waveform is attenuated to a large extent, and accordingly the frequency increases, as compared with a case where the sensor cavity 222 is filled with ink. The increase in frequency allows the detection of the ink end.

Specifically, when a voltage is applied to the piezoelectric element 226, the vibrating plate 224 is deformed due to deformation of the piezoelectric element 226. After the piezoelectric element 226 is forcibly deformed, when application of the voltage is stopped, a flexural vibration remains in the vibrating plate 224 for a period of time. This residual vibration occurs due to a free vibration of the vibrating plate 224 and the medium in the sensor cavity 222. Therefore, a resonant state of the vibrating plate 224 and the medium after the voltage is applied can be easily obtained by applying the voltage with a pulse waveform or a rectangular waveform to the piezoelectric element 226.

This residual vibration occurs due to the vibration of the vibrating plate 224, and is accompanied by deformation of the piezoelectric element 226. For this reason, the piezoelectric element 226 produces a counter electromotive force due to the residual vibration.

The circuit board 250 has an electrode that is connected to a through hole (not shown) formed to pass through the circuit board 250. A signal from the relay terminal 240, which comes into contact with the sensor chip 220, is transmitted to an analysis circuit (not shown) mounted in a printer body, through the through hole and the electrode, and processed by the analysis circuit. The analysis result is transmitted to a semiconductor memory device (not shown) mounted on the circuit board 250. That is, the counter electromotive force produced by the piezoelectric element 226 is transmitted to the analysis circuit through the relay terminal 240, and the analysis result is stored in the semiconductor memory device.

A resonance frequency can be specified based on the detected counter electromotive force. Therefore, presence or absence of ink in the ink cartridge 100 can be detected on the basis of the resonance frequency. The semiconductor memory device stores identification information regarding the type of the ink cartridge 100, information regarding the color of ink contained in the ink cartridge 100, and information regarding the ink level.

Ink, which remains in the sensor cavity 222, is introduced into the downstream buffer chamber 134*b* through the second hole 214 of the sensor base 210 shown in FIG. 12 when ink is further supplied. Ink flows through the ink delivery channel 134 via the ink discharge port 135*b*, and is discharged from the ink cartridge 100 through the ink supply portion 110 (see FIG. 2).

(Sensor Base Support Method and Support Structure)

The following two steps are needed for arranging the sensor base 210, the sensor chip 220, and the film 202 in the opening 130. Specifically, it is necessary to perform a first step of disposing the metal sensor base 210 having mounted thereon the sensor chip 220 in the opening 130 of the body case 102, in which the channel 134 is formed, such that the metal sensor base 210 faces the channel 134, and a second step of welding the film 202 to the rib 132 around the opening 130 such that the sensor base 210 is supported by the body case 102 through the film 202. The first step and the second step allow the sensor cavity 222 in the sensor chip 220 to communicate with the upstream buffer chamber 134*a* through the first hole 212 in the sensor base 210, and communicate with the downstream buffer chamber 134*b* through the second hole 214 in the sensor base 210, thereby forming a liquid detection path, as described above.

In this embodiment, the sensor base 210 is supported only by the partition wall 136 (support function of the partition wall) in the first step before the film 202 is welded. This is because, before the film 202 is welded to the welding rib 132 around the opening 130, the sensor base 210 needs to be temporarily positioned at a predetermined location in the opening 130. In the second step, after the sensor base 210 is supported by the film 202, the sensor base 210 can come into contact with only the partition wall 136 in a depth direction of the opening 130 (upstream/downstream partition function of the partition wall). Since the sensor base 210 is supported by the film 202, the sensor base 210 need not be always in contact with the partition wall 136, but the partition wall 136 must constantly achieve the upstream/downstream partition function.

(Sensor Base Positioning)

As shown in FIG. 10, the sensor base 210 has four sides, which are respectively opposite along two perpendicular axes). The sensor base 210 has four sides from the viewpoint of positioning, but a shape which connects each side is not limited. Four positioning portions 150, 151, 152, and 153, which protrude toward the four sides of the sensor base 210, are provided in the opening 130 of the body case 102 at positions opposite to the four sides of the sensor base 210. Of these, the positioning portion 150 is longitudinally formed along one side (particularly, long side) of the sensor base 210, and is separated into two parts by the bottom bypass 400. The positioning portions 151 to 153 are locally provided on the remaining three sides of the sensor base 210.

The sensor base 210 is positioned in the opening 130 by setting a design tolerance for a gap F1 between the four sides of the sensor base 210 (four sides are respectively opposite along two perpendicular axes) and the four positioning portions 150 to 153. The sensor base 210 is effectively positioned with respect to a rotation direction by forming at least one positioning portion 150 from among the four positioning portions longitudinally along one side (particularly, long side) of the sensor base 210. Note that it is undesirable to increase the area of the gap F1 since air bubbles are produced. From the viewpoint of limiting rotation, what is necessary is that a longitudinal positioning portion is formed along only one side of the sensor base 210.

A gap F2, which is sufficiently larger than the gap F1 according to the design tolerance, is formed between the wall of the opening 130 and the four sides of the sensor base 210 in an area excluding the four positioning portions 150, 151, 152, and 153. The gap F2 is formed in a part of the channel 134, which is formed by one of the upstream buffer chamber 134*a* and the downstream buffer chamber 134*b* partitioned by the partition wall 136.

In a state where the inside of the body case 102 is approximately under vacuum, ink is filled. In this case time, the gap E2, which communicates with the upstream buffer chamber 134*a* or the downstream buffer chamber 134*b* can function as an ink flow channel. Therefore, when the upstream buffer chamber 134*a* and the downstream buffer chamber 134*b* are filled with ink, the gap F2 is also filled with ink, and bubbles do not remain.

This prevents the ink end from being erroneously detected.

(Ink Flow Channel and Bottom Bypass During Ink Detection)

Figure 15:
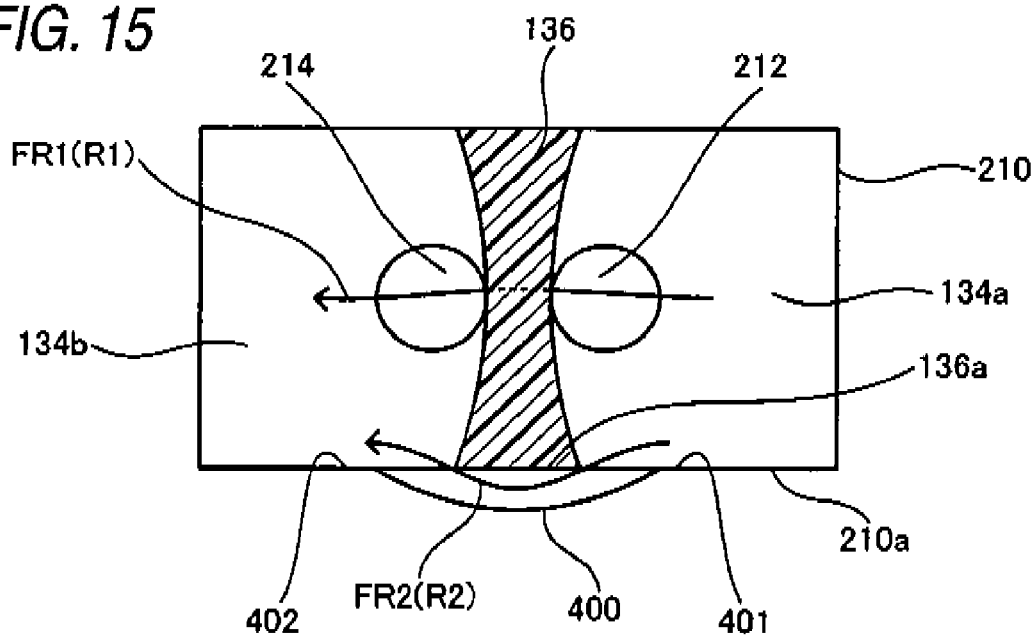
FIG. 15 is a diagram schematically showing a flow channel of ink from an upstream buffer chamber to a downstream buffer chamber when a cartridge subject to ink detection is used.

FIG. 15 schematically shows a flow channel of ink from the upstream buffer chamber 134*a* to the downstream buffer chamber 134*b* when the ink cartridge subject to ink detection is used. When the ink cartridge is used, as shown in FIG. 15, the first and second holes 212 and 214 of the sensor base 210 are arranged in parallel at the same height in the vertical direction. One of both sides of the partition wall 136 provided between the first and second holes 212 and 214 to extend along the sensor base 210 in the vertical direction becomes the upstream buffer chamber 134*a*, and the other side becomes the downstream butter chamber 134*b*. During ink detection, as shown in FIG. 15, ink in the upstream buffer chamber 134*a* flows into the sensor cavity 222 through the first hole 212 of the sensor base 210, and flows into the downstream buffer chamber 134*b* through the second hole 214 of the sensor base 210. This is a first flow channel FR1. When the liquid level of the upstream and downstream buffer chambers 134*a* and 134*b* are lowered, air enters the sensor cavity 222 through the first hole 212, absence of ink is detected, as described above.

As shown in FIG. 15, ink in the upstream buffer chamber 134*a* goes toward the sensor cavity 222 through the first hole 212 of the sensor base 210, which is formed in an intermediate part, not the uppermost part, in the vertical direction of the upstream buffer chamber 134*a*. Therefore, even though air bubbles are mixed in the upstream buffer chamber 134*a*, the air bubbles having low specific gravity go upward in the vertical direction, and thus the air bubbles are hard to flow into the sensor cavity 222. As a result, erroneous detection due to air bubbles mixed into ink is rarely generated, as compared with the structures described in JP-A-2006-281550 and JP-A-2006-341599.

In this embodiment, as shown in FIG. 15, openings 401 and 402 are provided at the lowermost positions in the vertical direction of the upstream and downstream buffer chambers 134*a* and 134*b*, respectively, and the bottom bypass 400 is provided to pass through the lower side of the partition wall 136 and communicate the upstream and downstream buffer chambers 134*a* and 134*b* with each other. An ink flow channel by the bottom bypass 400 is a second flow channel FR2. The bottom bypass 400 is also shown in FIGS. 3 and 10 to 12. As shown in FIGS. 10 to 12 and 15, the bottom bypass 400 is formed so as to be disposed below the lowermost end 210*a* of the sensor base 210 when the ink cartridge is used. In other words, as shown in FIG. 15, the bottom bypass 400 is formed so as to be disposed below the lowermost end 136*a* of the partition wall 136 when the ink cartridge is used. For this reason, the bottom bypass 400 can be formed even though the partition wall 136 supporting the sensor base 210 is not cut out.

As shown in FIG. 11, the bottom bypass 400 is formed by cutting out the body case 102 below the lowermost end 210*a* of the sensor base 210, and sealing the opening with the film 202. The opening is not necessarily sealed with the film 202. The bottom bypass 400 may be formed of a groove in the body case 102.

From the viewpoint of prevention of inclination of the sensor base 210, it is desirable to form the bottom bypass 400 without cutting out the partition wall 136 supporting the sensor base 210. As shown in FIG. 3, the sensor base 210 is pressed when the sensor chip 220 mounted on the sensor base 210 comes into contact with the terminal 242 of the relay terminal 240. For this reason, when a cutout is provided in the partition wall 136 in order to form the bottom bypass 400, a contact area of the partition wall 136 supporting the sensor base 210 is decreased, and the sensor base 210 is likely to be inclined. As a result, poor contact of the terminal 242 and the sensor chip 220 is likely to occur. In contrast, according to this embodiment, such a problem does not occur.

The flow channel resistance R2 of a flow channel (second flow channel FR2) of ink flowing in the bottom bypass 400 is equal to or more than the flow channel resistance of a flow channel (first flow channel FR1) of ink from the first hole 212 to the second hole 214 through the sensor cavity 222 ($R2 \geqq R1$). That is, in the second flow channel FR2, ink easily flows to the same extent as the first flow channel FR1 or ink is hard to flow as compared with the first flow channel FR1. Therefore, when ink detection is performed, it becomes possible to allow easy flow of ink by decreasing the total flow channel resistance of the upstream and downstream buffer chambers 134*a* and 134*b*, while ensuring independent use of the first flow channel FR1.

In FIG. 15, when the liquid level is lowered less than the first and second holes 212 and 214 at the same height, ink does not flow in the first flow channel FR1. However, ink which remains in the upstream buffer chamber 134*a* can flow into the downstream buffer chamber 134*b* through the second flow channel FR2 using the bottom bypass 400. Therefore, ink in the upstream buffer chamber 134*a* can be used thoroughly.

(First Modification of Bottom Bypass)

Figure 16:
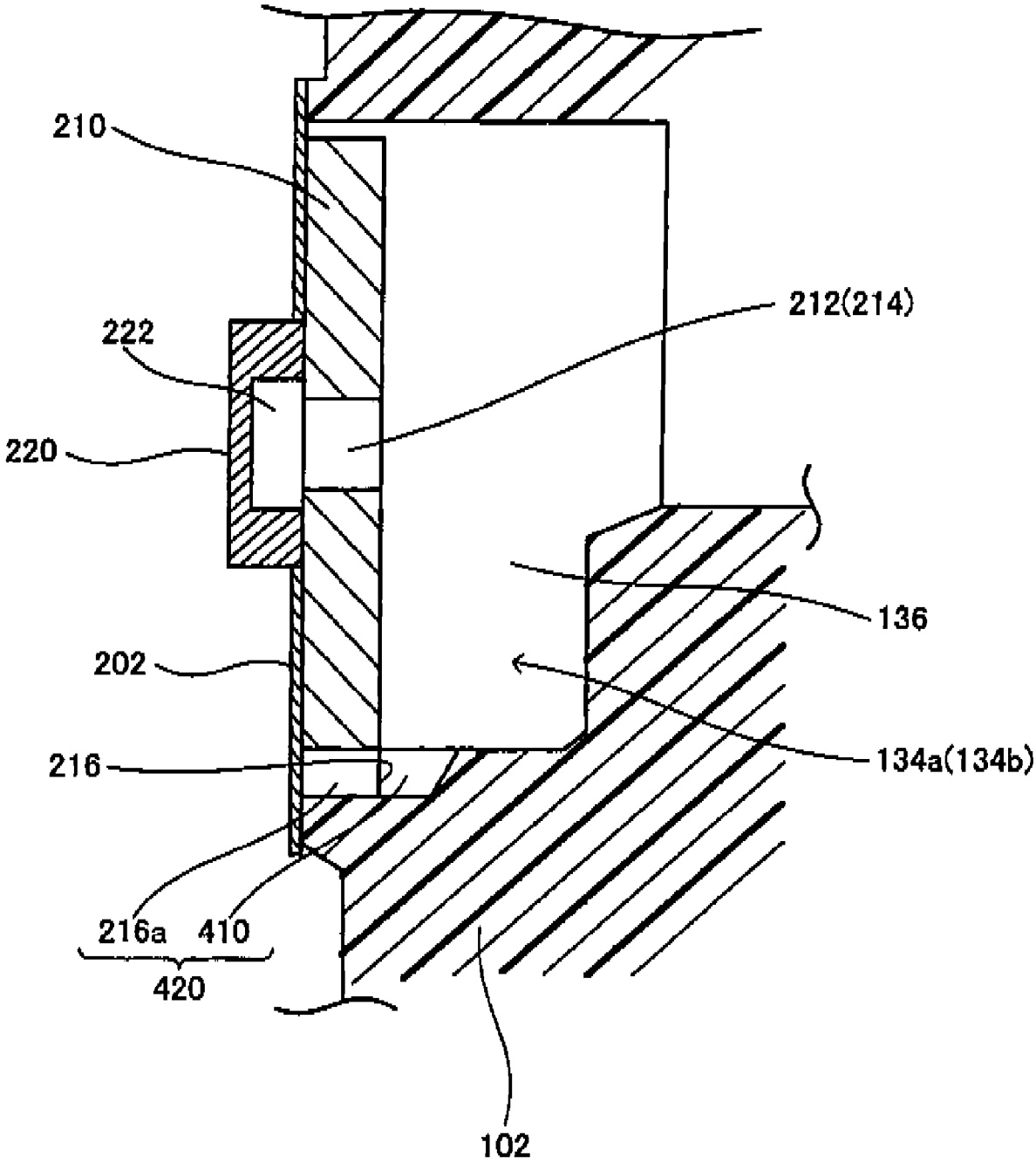
FIG. 16 is a diagram showing a first modification of a bottom bypass.

FIG. 16 shows a first modification of a bottom bypass. In FIG. 16, a bypass 410 is provided below partition wall 136 by cutting out the body case 102. The 6 sensor base 210 has a long extended portion 216 below the partition wall 136, and a cutout 216*a* is provided in a part of the extended portion 216. The cutout 216*a* has a space larger than the thickness of the partition wall 136. The front surface of the sensor base 210 including the cutout 216*a* is sealed with the film 202, and the rear surface of the cutout 216*a* faces the bypass 410. A bottom bypass 420 is formed of the bypass 410, the cutout 216*a* which communicates with the bypass 410, and the film 202 which seals the front surface of the cutout 216*a*.

With this structure, the cutout 216*a* is provided in the sensor base 210, but the cutout 216*a* is provided in the extended portion 216, which is not in contact with the partition wall 136. In this case, therefore, the contact area of the partition wall 136 supporting the sensor base 210 can be secured and there is no case where the sensor base 210 is inclined due to the pressing force from the terminal 242.

Figure 17:
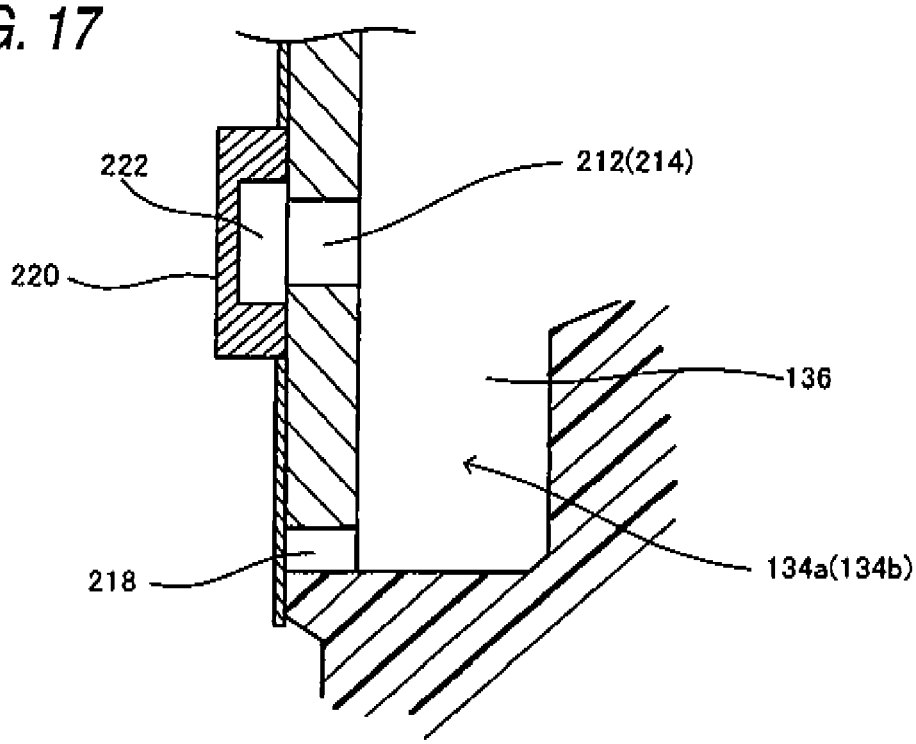
FIG. 17 is a diagram showing another modification of a bottom bypass.

The bottom bypass may be formed of only the cutout 216*a* of the sensor base 210. In this case, as shown in FIG. 17, a cutout 218, which is formed at the lowermost end of each of the upstream and downstream buffer chambers 134*a* and 134*b* and has a space larger than the thickness of the partition wall 136 at a position opposite to the partition wall 136, may be formed at the bottom of the sensor base 210.

(Intermediate Bypass)

In this embodiment, as shown in FIGS. 3, 11, and 12, an intermediate bypass 500 is provided at a position where the partition wall 136 faces the sensor base 210. The intermediate bypass 500 is formed by cutting out a part of the partition wall 136 such that the upstream and downstream buffer chamber 134*a* and 134*b* communicate with each other.

In the example shown in FIGS. 3, 11, and 12, the intermediate bypass 500 is formed by cutting out the partition wall 136 at a position between the first and second holes 212 and 214 and the bottom bypass 400 in the vertical direction when the ink cartridge is used.

Figure 18:
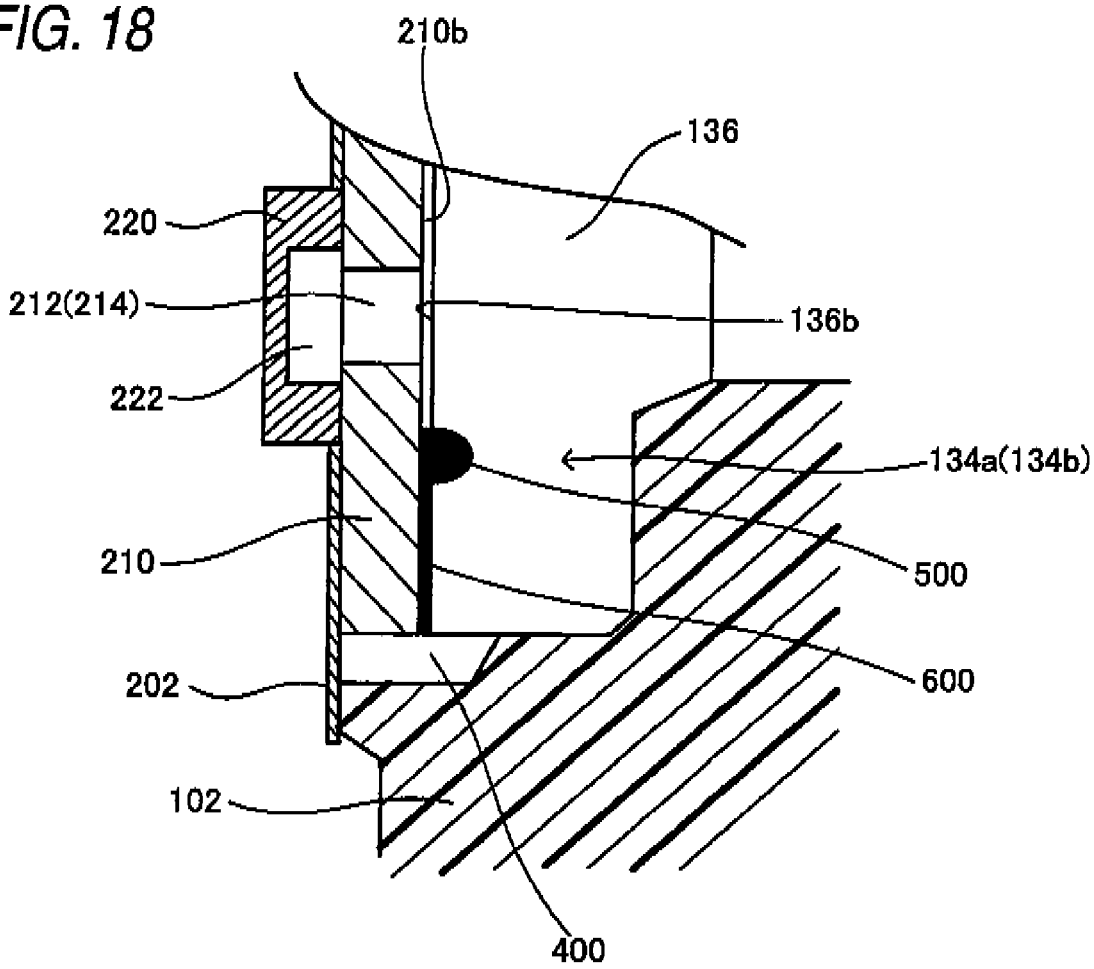
FIG. 18 is a diagram illustrating the operation of an intermediate bypass.

The operation of the intermediate bypass 500 will be described with reference to FIG. 18. In FIG. 18, it is assumed that ink in the upstream buffer chamber 134*a* is absent. Accordingly, before the state of FIG. 18, air enters the sensor cavity 222, and thus "ink absent" is detected.

FIG. 18 shows a state where a slight gap is formed between one surface 210*b* of the sensor base 210 and an opposing surface 136*b* of the partition wall 136, and ink 600 flows up along the gap by a capillary phenomenon.

In this embodiment, since the bottom bypass 400 is provided, after absence of ink is detected, ink in the upstream buffer chamber 134*a* can be substantially thoroughly discharged to the downstream buffer chamber 134*b*. However, during the discharge process or when ink remains in the downstream buffer chamber 134*b*, a strong capillary phenomenon occurs due to a slight gap between the one surface 210*b* of the sensor base 210 and the opposing surface 136*b* of the partition wall 136. For this reason, residual ink flows up along the gap.

In this embodiment, the intermediate bypass 500 is provided in a path through which ink flows up along the gap. The storing capillary phenomenon is weakened at the intermediate bypass 500, and ink flowing up can be trapped in the intermediate bypass 500. Therefore, it is possible to prevent "ink present" from being erroneously detected when ink continues to flow up and enter the sensor cavity 222 through the first hole 212.

The ink detection is performed when the carriage 1 shown in FIG. 1 is at a position other than the printing region, for example, the home position. When "ink absent" is detected during last printing, and the printer is operated a few days after, the sensor cavity 222 may be filled with ink due to the capillary phenomenon, and "ink present" may be erroneously detected. Alternatively, while the upstream buffer chamber 134*b* is empty during printing and the carriage 1 approaches the home position, ink may quickly flow due to the capillary phenomenon and fill the sensor cavity 222, and accordingly "ink present" may be erroneously detected.

In this embodiment, since the intermediate bypass 500 is provided in a path through which ink flows up due to the capillary phenomenon, it is possible to suppress occurrence of the above-described problems.

The intermediate bypass 500 basically functions to trap ink flowing up due to the capillary phenomenon, and also functions as a bypass which communicates the upstream and downstream buffer chambers 134*a* and 134*b* with each other to form an ink flow channel.

The bypass function is necessary for ensuring that the intermediate bypass 500 does not retain ink before the capillary phenomenon occurs. If ink is trapped in the intermediate bypass 500 before the capillary phenomenon occurs, the ink trap function after the capillary phenomenon occurs is not sufficiently facilitated.

The flow channel resistance R3 of ink flowing the intermediate bypass 500 is sufficiently larger than the flow channel resistance R2 of ink flowing the bottom bypass 400 (R3>>R2). That is, ink from the upstream buffer chamber 134*a* to the downstream buffer chamber 134*b* most easily flows in the first flow channel FR1 shown in FIG. 15, slightly easily flows in the second flow channel FR2, and is hard to flow in the intermediate bypass 500. Therefore, the total flow channel resistance of ink from the upstream buffer chamber 134*a* to the downstream buffer chamber 134*b* is lowered, and easy flow of ink is ensured. Meanwhile, it is ensured that the ink detection is reliably performed by the sensor cavity 222.

(Modification of Intermediate Bypass)

Figure 19:
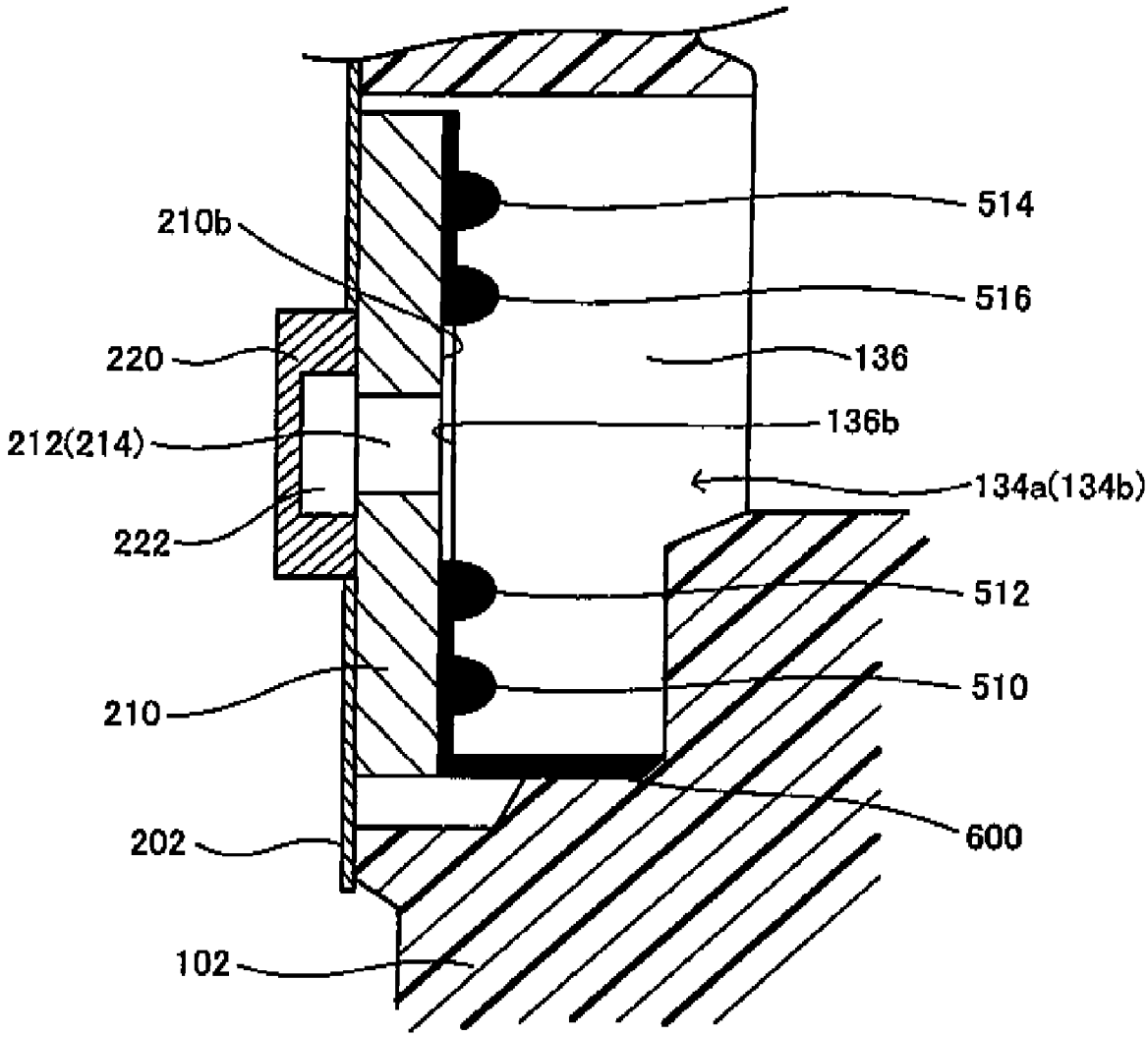
FIG. 19 is a diagram showing a modification of an intermediate bypass.

FIG. 19 shows a modification of an intermediate bypass. In FIG. 19, an intermediate bypass is provided in an ink detection device not having the bottom bypass 400. In FIG. 19, when the ink cartridge is used, a plurality of, for example, two intermediate bypasses 510 and 512 are provided below the first and second holes 212 and 214. In FIG. 19, a plurality of, for example, two intermediate bypasses 514 and 516 are also provided above the first and second holes 212 and 214.

In the example of FIG. 19, since the bottom bypass 400 is not provided, ink 600 is likely to remain in the upstream buffer chamber 134*a*. For this reason, ink 600 remaining in the upstream buffer chamber 134*a* flows up along a slight gap between one surface 210*b* of the sensor base 210 and an opposing surface 136*b* of the partition wall 136 due to the capillary phenomenon.

However, ink 600 is trapped in the plurality of intermediate bypasses 510 and 512 provided in a path through which ink 600 flows up. Therefore, it is possible to prevent ink 600 from reaching the sensor cavity 222.

The capillary phenomenon may occur above the first and second holes 212 and 214. This is because a strong meniscus is formed at an edge at which the sensor base 210 and the partition wall 136 intersect each other, and ink 600 remaining in the meniscus moves along a slight gap between the one surface 210*b* of the sensor base 210 and the opposing surface 136*b* of the partition wall 136 due to the capillary phenomenon. In this case, ink 600 may flow down along the gap. However, ink 600 is trapped in the plurality of intermediate bypasses 514 and 516 in a path through which ink 600 flows down, and therefore it is possible to prevent ink 600 from reaching the sensor 26 cavity 222.

A single intermediate bypass may be provided in each of the paths, through which ink 600 flows up and down, shown in FIG. 19. Alternatively, as shown in FIG. 18, in case of an ink detection device having the bottom bypass 400, a plurality of intermediate bypasses may be provided in the path through which ink 600 flows up. At least one intermediate bypass may be provided in the path through which ink 600 flows down.

Although the embodiment has been described in detail, it can be easily understood by those skilled in the art that various modification can be made without departing in substance from the new matters and effects of the invention. Therefore, all of those modifications are deemed included in the scope of the invention. For example, the terms cited in the description in the specification or the drawings as the terms in broad sense or in a similar sense may be replaced by the terms in a broad sense or in a similar sense in another description in the specification or the drawings.

Figure 20:
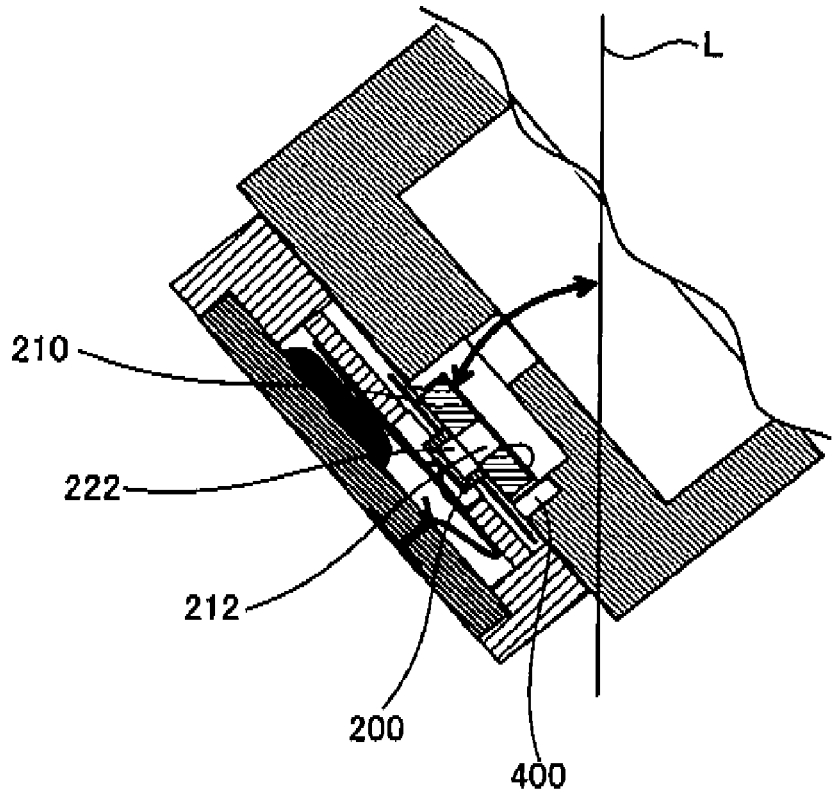
FIG. 20 is a diagram showing a state where a sensor base is arranged obliquely with respect to a vertical line.
Figure 21:
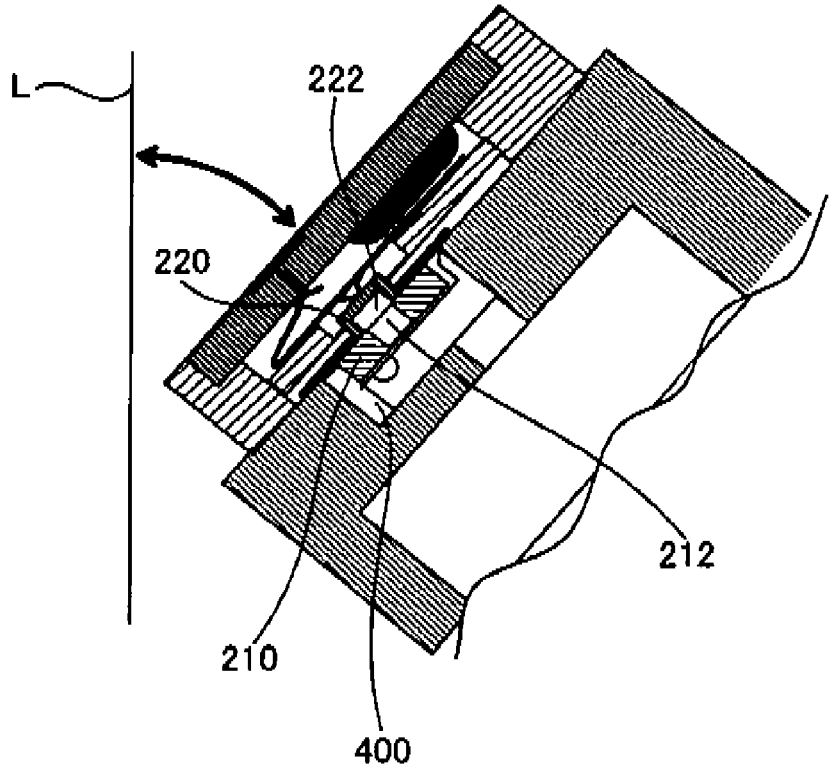
FIG. 21 is a diagram showing a state where a sensor base is arranged obliquely with respect to a vertical line in a direction different from that in FIG. 20.

In the foregoing embodiment, a state where the sensor base 210 stands upright when the ink cartridge is used has been described, but the invention is not limited thereto. The sensor base 210 may be used obliquely with respect to the vertical direction. FIGS. 20 and 21 show a state where the ink cartridge 200 is rotated at a predetermined angle in a clockwise or counterclockwise direction with respect to a vertical line L, and the sensor base 210 is inclined. In any cases, the bottom bypass 400 is formed at the lowermost position of the upstream butter chamber 134*a*, and is arranged so as to be lower than an inlet to the sensor cavity 222. For this reason, ink remaining in the upstream buffer chamber 134*a* can flow into the downstream buffer chamber 134*b* through the bottom bypass 400.

(Second Modification of Bottom Bypass)

Figure 23:
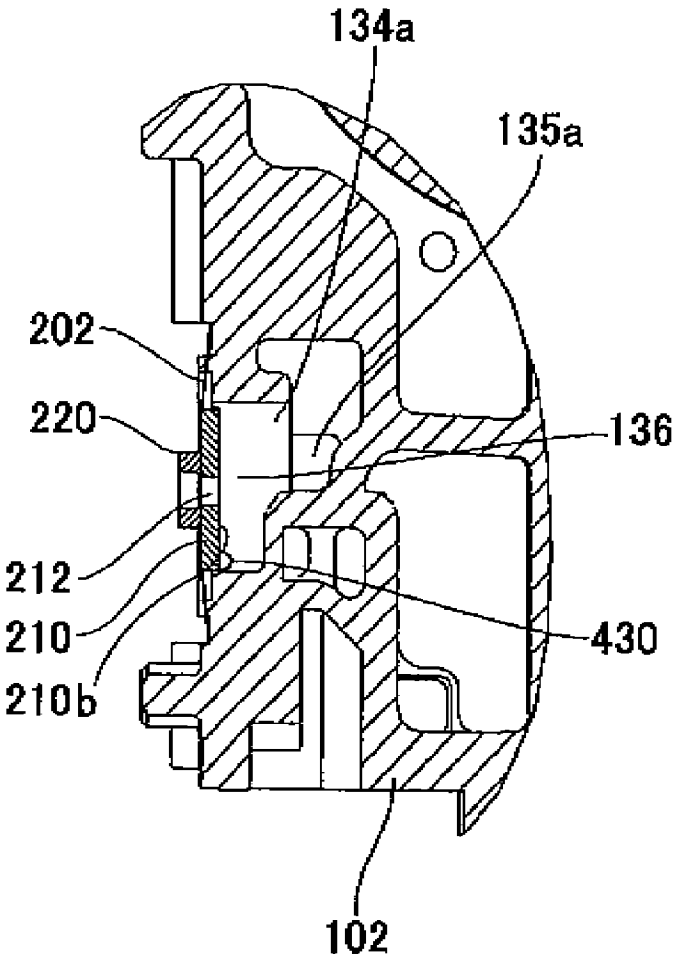
FIG. 23 is a sectional view taken along the line C1-C1 of FIG. 22.
Figure 22:
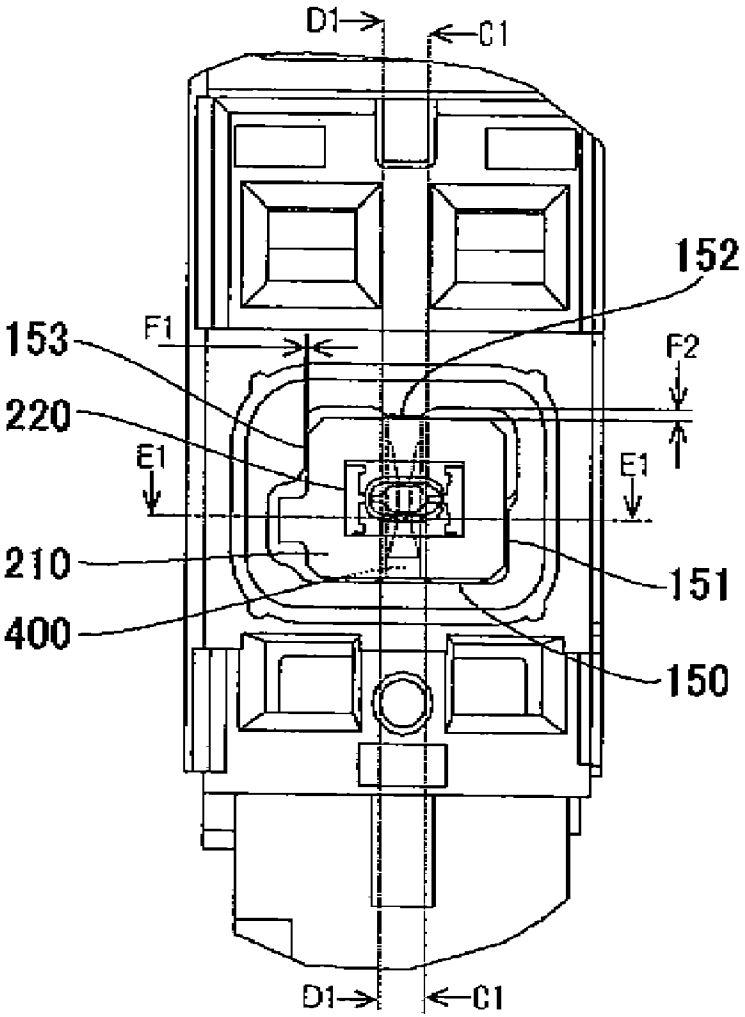
FIG. 22 is a plan view schematically showing a state where a sensor base and a sensor chip of an ink detection device having a bottom bypass according to a second modification are arranged in an opening and assembled.
Figure 24:
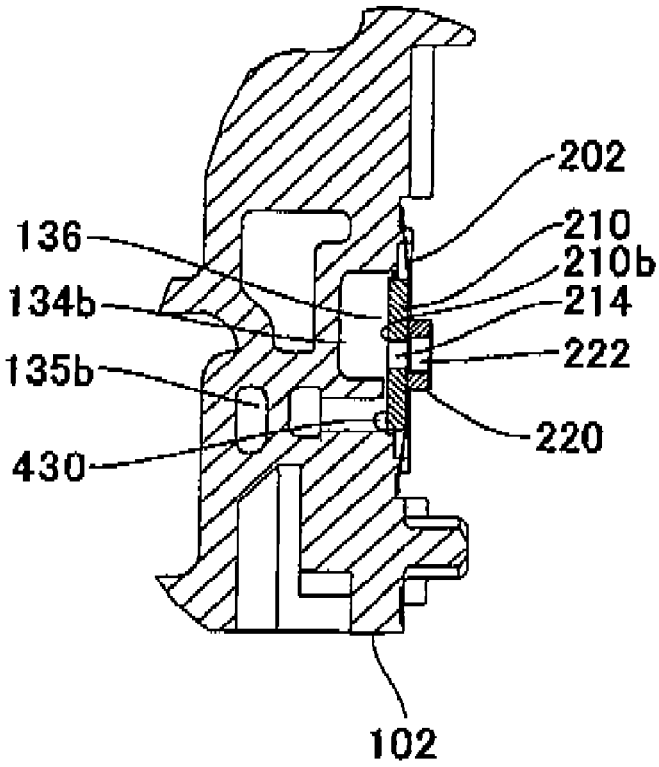
FIG. 24 is a sectional view taken along the line D1-D1 of FIG. 22.
Figure 25:
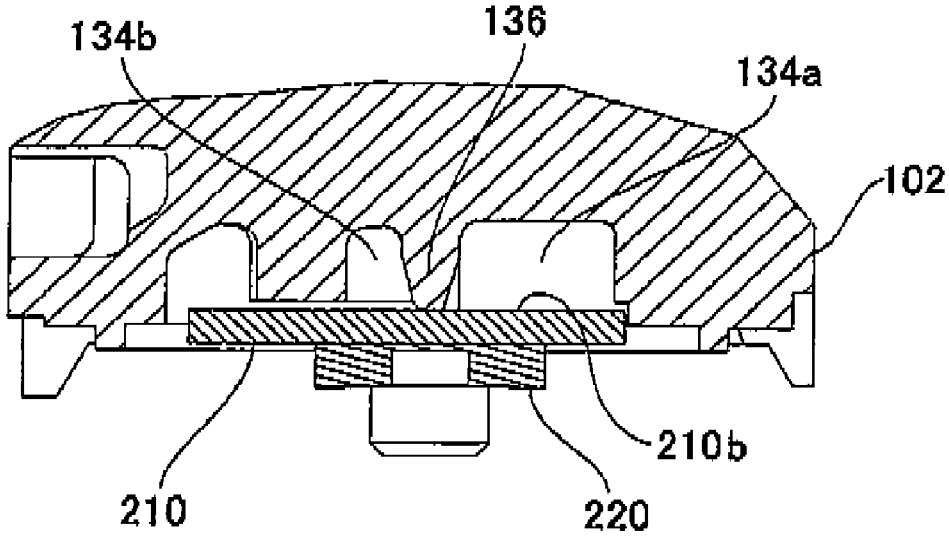
FIG. 25 is a sectional view taken along the line E1-E1 of FIG. 22.
Figure 26:
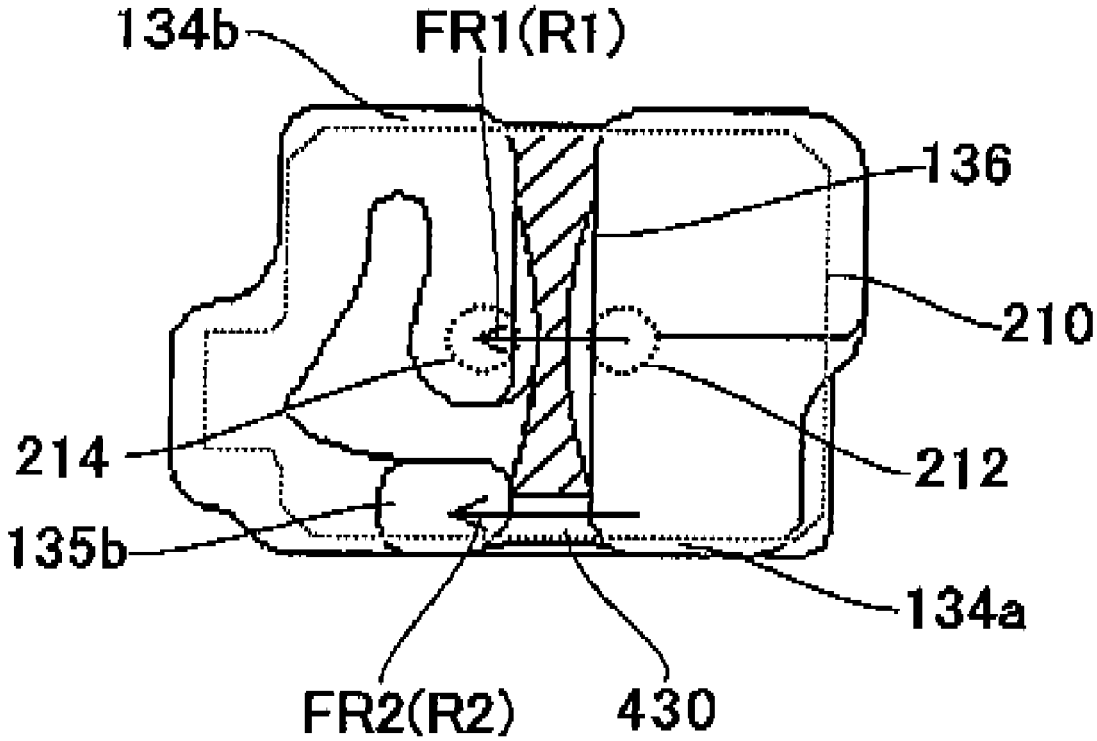
FIG. 26 is a diagram schematically showing a flow channel of ink from an upstream buffer chamber to a downstream buffer chamber when a cartridge subject to ink detection is used.

FIG. 22 corresponds to FIG. 15 and is a plan view schematically showing a state where a sensor base and a sensor chip of an ink detection device having a bottom bypass of a second modification are arranged in an opening and assembled. FIGS. 23, 24, 25, and 26 correspond to FIGS. 11, 12, 13, and 15, and the same parts are represented by the same reference numerals. A bottom bypass 430, which is the bottom bypass of the second modification, is shown in FIGS. 23, 24, and 26. The bottom bypass 430 is provided at a lower position in the vertical direction in the upstream buffer chamber 134*a* and the downstream buffer chamber 134*b*, and communicates the upstream buffer chamber 134*a* and the downstream buffer chamber 134*b* with each other along the sensor base 210. That is, in the second modification, the bottom bypass 430 is provided between the sensor base 210 and the partition wall 136, and specifically, the bottom bypass 430 is formed of a cutout formed in one surface 210*b* of the sensor base 210 and at a lower end of the partition wall 136.

The use of the liquid container according to the invention is not limited to the ink cartridge of the ink jet recording apparatus. For example, the liquid container of the invention may be used for various liquid consuming apparatuses having a liquid ejecting head that ejects a minute amount of liquid droplets.

Specific examples of the liquid consuming apparatus having a liquid ejection head include an apparatus having a color material ejection head used in manufacturing color filters of a liquid crystal display or the like, an apparatus having an electrode material (conductive paste) ejection head used in forming electrodes of an organic EL display or a surface emission display (FED), an apparatus having a bioorganic compound ejection head used in manufacturing a bio chip, an apparatus having a sample spraying head as a precision pipette, a textile printing apparatus, or a micro dispenser.

The liquid detector of the invention may be assembled into a sub printer or an off carriage-type ink cartridge not mounted on a carriage, in addition to an on carriage type ink cartridge.

In the foregoing embodiment, the case of the liquid detector is formed by a part of the body case of the liquid container, while silicon rubber or spring described in JP-A-2006-281550 is excluded. However, the invention is not limited thereto. The liquid detector may be formed as a separate unit from the body case of the liquid container. The case means a unit case. Here, silicon rubber or spring may not be excluded. Meanwhile, even though the unit case is increased in size, vibration absorption by the unit case can be minimized, and therefore sufficient amplitude of a detection waveform can be secured.

In the foregoing embodiment, the liquid ejecting apparatus may be embodied in a so-called full-line type (line head type) printer in which, in a direction intersecting a transfer direction (front-back direction) of the recording sheet (not shown), the entire shape of the recording head 19 corresponds to the length in the widthwise direction (left-right direction) of the recording sheet (not shown).

Although, in the foregoing embodiment, the liquid ejecting apparatus is embodied in the ink jet printer 11, the invention is not limited thereto. The invention may be embodied in a liquid ejecting apparatus that ejects or discharges a liquid other than ink (a liquid state material, in which particles of function material are dispersed or mixed, or a fluid state material, such as gel). For example, it may be a liquid ejecting apparatus that ejects a liquid state material, in which an electrode material or a color material (pixel material) is dispersed or dissolved, and is used in manufacturing a liquid crystal display, an EL (Electro Luminescence) display, or a field emission display, a liquid ejecting apparatus that ejects a bioorganic material used in manufacturing a bio-chip, or a liquid ejecting apparatus that ejects a liquid (sample) as a precision pipette. In addition, it may be a liquid ejecting apparatus that pinpoint ejects a lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, a liquid ejecting apparatus that ejects an etchant, such as acid or alkali, to etch a substrate, or a liquid ejecting apparatus that ejects a liquid state material, such as gel (for example, physical gel). The invention can be applied to one of liquid ejecting apparatuses. Moreover, in this specification, the term "liquid" is a concept including a liquid (an inorganic solvent, an organic solvent, a solution, liquid resin, a liquid metal (metal melt)), a liquid state material, or a fluid state material, not a fluid containing only gas.

What is claimed is:

1. A liquid detector comprising:

a case, having an opening through which a flow channel is exposed;

a sensor base, having a first surface facing the flow channel through the opening, and having a second surface opposite to the first surface;

a sensor chip, mounted on the second surface of the sensor base;

a film, adapted to hold the sensor base in the opening, and adapted to seal the opening; and a partition wall, dividing a part of the flow channel in the case into an upstream buffer chamber and a downstream buffer chamber, wherein the sensor chip includes a sensor cavity adapted to receive a liquid to be detected, the sensor base has: a first hole through which the liquid is introduced from the upstream buffer chamber to the sensor cavity; and a second hole through which the liquid is introduced from the sensor cavity to the downstream buffer chamber, and during liquid detection, the first and second holes are arranged in parallel at the same height in a vertical direction, the partition wall is arranged between the first and second holes so as to extend along the sensor base in the vertical direction, and a bottom bypass is formed at a lowermost position in the vertical direction of each of the upstream and downstream buffer chambers to communicate the upstream and downstream buffer chambers with each other.

2. The liquid detector according to claim 1, wherein a flow channel resistance of the liquid flowing in the bottom bypass is equal to or more than a flow channel resistance of the liquid flowing into the second hole from the first hole through the sensor cavity.

3. The liquid detector according to claim 1, wherein the bottom bypass is formed below a position corresponding to a lowermost end of the partition wall in the vertical direction during the liquid detection.

4. The liquid detector according to claim 1, wherein the bottom bypass is formed below a position corresponding to a lowermost end of the sensor base in the vertical direction during the liquid detection.

5. The liquid detector according to claim 4, wherein apart of a flow channel of the bottom bypass is defined by the film.

6. The liquid detector according to claim 1, wherein the sensor base is formed with a cutout, and the bottom bypass is defined by the cutout and the film.

7. The liquid detector according to claim 1, wherein the bottom bypass is arranged between the partition wall and the sensor base.

8. The liquid detector according to claim 7, wherein the bottom bypass is defined by a cutout formed at a lower end of the partition wall and the first surface of the sensor base.

9. The liquid detector according to claim 1, further comprising:

at least one intermediate bypass, provided at a position at which the partition wall faces the sensor base, and formed by cutting out a part of the partition wall such that the upstream and downstream buffer chambers communicate with each other.

10. The liquid detector according to claim 9, wherein the at least one intermediate bypass is formed by cutting out the partition wall at a position between the first and second holes and the bottom bypass in the vertical direction during the liquid detection.

11. The liquid detector according to claim 9, wherein a flow channel resistance of the liquid flowing in the at least one intermediate bypass is larger than a flow channel resistance of the liquid flowing in the bottom bypass.

12. The liquid detector according to claim 1, wherein the sensor chip includes a piezoelectric element, and the sensor base is positioned between the first and second holes of the sensor base in a depth direction of the opening so as to be in contact with the case only through the partition wall.

13. The liquid detector according to claim 1, wherein the sensor base has four sides, the four sides being respectively opposite along perpendicular axes, at least four positioning portions are provided in at least the opening of the case to protrude toward the four sides of the sensor bases at positions opposite to the four sides of the sensor base, and in an area excluding the at least four positioning portions, a gap between a wall of the opening and the four sides of the sensor base forms a part of a flow channel in the upstream buffer chamber or the downstream buffer chamber.

14. The liquid detector according to claim 1, wherein the case is a part of a container containing the liquid.

15. A liquid container comprising:

a case, including a liquid containing portion, a flow channel communicating with the liquid containing portion, and an opening exposing the flow channel;

a sensor base, having a first surface facing the flow channel through the opening, and having a second surface opposite to the first surface;

a sensor chip, mounted on the second surface of the sensor base;

a film, adapted to hold the sensor base in the opening, and adapted to seal the opening; and a partition wall, dividing a part of the flow channel in the case into an upstream buffer chamber and a downstream buffer chamber, wherein the sensor chip includes a sensor cavity adapted to receive a liquid to be detected, the sensor base has: a first hole through which the liquid is introduced from the upstream buffer chamber to the sensor cavity; and a second hole through which the liquid is introduced from the sensor cavity to the downstream buffer chamber, in a posture in which the sensor base is arranged in a vertical direction, the first and second holes are arranged in parallel at the same height, and the partition wall is disposed between the first and second holes and arranged along the sensor base in the vertical direction, and a bypass flow channel is provided at a lowermost position in the upstream and downstream buffer chamber in the vertical direction to communicate the upstream buffer chamber and the downstream buffer chamber with each other.

16. The liquid container according to claim 15, wherein the bypass flow channel is formed between the partition wall and the sensor base.

17. The liquid container according to claim 16, wherein the bypass flow channel is defined by a cutout formed at a lower end of the partition wall and the first surface of the sensor base.

18. A liquid container comprising:

a liquid containing portion, adapted to contain a liquid;

a liquid supply portion, adapted to supply the liquid to the outside;

a flow channel, communicating the liquid containing portion and the liquid supply portion with each other;

a liquid sensor, operable to detect presence or absence of the liquid in a cavity, the liquid sensor having: a first opening through which the liquid is introduced from the flow channel to the cavity; and a second opening through which the liquid is introduced from the cavity to the flow channel;

a partition wall, interposed between the first opening and the second opening, and dividing the flow channel into a first buffer chamber and a second buffer chamber; and a bypass flow channel, provided between the liquid sensor and the partition wall, and communicating the first buffer chamber and the second buffer chamber with each other, wherein, in a posture of the liquid container when being used, the bypass flow channel is provided so as to communicate a lower end of the first buffer chamber and a lower end of the second buffer chamber with each other below the first opening and the second opening.

19. The liquid container according to claim 18, wherein the liquid sensor includes a base member with which the first opening and the second opening are formed, and a first surface of which defines a part of the cavity, and the bypass flow channel is defined by a second surface opposite to the first surface of the base member and a cutout formed with the partition wall.

20. The liquid container according to claim 19, wherein the flow channel has an opening through which the flow channel is exposed to the outside, and the liquid sensor is supported by a film fixed to the first surface of the base member and is fixed so as to cover the opening.

* * * * *